US011663908B2

(12) United States Patent
Petit et al.

(10) Patent No.: US 11,663,908 B2
(45) Date of Patent: May 30, 2023

(54) METHOD AND SYSTEM FOR MISBEHAVIOR DETECTION REPORT MANAGEMENT ROUTING

(71) Applicant: QUALCOMM Incorporated, San Diego, CA (US)

(72) Inventors: Jonathan Petit, Wenham, MA (US); William Whyte, Belmont, MA (US); Cong Chen, Shrewsbury, MA (US); Jean-Philippe Monteuuis, Levallois-Perret (FR); Mohammad Raashid Ansari, Lowell, MA (US)

(73) Assignee: QUALCOMM Incorporated, San Diego, CA (US)

( * ) Notice: Subject to any disclaimer, the term of this patent is extended or adjusted under 35 U.S.C. 154(b) by 23 days.

(21) Appl. No.: 17/317,270

(22) Filed: May 11, 2021

(65) Prior Publication Data

US 2022/0223033 A1 Jul. 14, 2022

Related U.S. Application Data

(60) Provisional application No. 63/137,324, filed on Jan. 14, 2021.

(51) Int. Cl.

*G08G 1/01* (2006.01)
*G08G 1/16* (2006.01)
(Continued)

(52) U.S. Cl.

CPC ..... *G08G 1/0125* (2013.01); *G07C 5/008* (2013.01); *G07C 5/0816* (2013.01); *G08G 1/012* (2013.01); *G08G 1/164* (2013.01)

(58) Field of Classification Search

CPC ..... G08G 1/0125; G08G 1/012; G07C 5/008; G07C 5/0816

See application file for complete search history.

(56) References Cited

U.S. PATENT DOCUMENTS 9,361,797 B1 * 6/2016 Chen ..... G08G 1/0141
10,157,539 B1 12/2018 Hoover et al.
(Continued)

OTHER PUBLICATIONS

ETSI: "Intelligent Transport Systems (ITS), Security, Misbehaviour Reporting Service, Release 2", ETSI Draft Specification, 103 759, European Telecommunications Standards Institute (ETSI), 650, Route Des Lucioles, F-06921 Sophia-Antipolis, France, No. V0.0.2, Jan. 12, 2021 (Jan. 12, 2021), pp. 1-27, XP014387961, Retrieved from the Internet: URL: ftp://docbox.etsi.org/ITS/ITSWG5/70-Draft/WG561/ITS-00561v002.docx [retrieved on Jan. 12, 2021] p. 8, paragraph 4.2—p. 10, paragraph 4.2.2.3. (27 pages).
(Continued)

*Primary Examiner* — Hongmin Fan
(74) *Attorney, Agent, or Firm* — The Marbury Law Group, PLLC

(57) ABSTRACT

Methods, misbehavior management systems, non-transitory processor-readable media of various embodiments provide for managing the generation, storage, and transmission of misbehavior reports from vehicle-to-everything (V2X) onboard equipment to an associated entity, such as a misbehavior managing authority. Various embodiments may include detecting a misbehavior condition has occurred and determining whether to generate a misbehavior report based on an aggregated criticality value. The misbehavior management system may then determine whether to store the generated misbehavior report. The misbehavior management system may also determine whether to transmit the generated misbehavior report to a misbehavior managing authority. In some embodiments, the misbehavior management system may determine which stored misbehavior reports may be deleted from storage.

27 Claims, 13 Drawing Sheets

(51) Int. Cl.
*G07C 5/08* (2006.01)
*G07C 5/00* (2006.01)

(56) References Cited

U.S. PATENT DOCUMENTS

| | | | | |
|---|---|---|---|---|
| 2006/0095175 | A1* | 5/2006 | deWaal | G07C 5/008 701/31.4 |
| 2016/0140842 | A1 | 5/2016 | Park et al. | |
| 2019/0312896 | A1* | 10/2019 | Petit | H04L 63/1416 |
| 2020/0137580 | A1* | 4/2020 | Yang | H04W 12/06 |
| 2020/0139980 | A1 | 5/2020 | Liu et al. | |
| 2020/0258320 | A1* | 8/2020 | Lu | G08G 1/092 |
| 2020/0280842 | A1 | 9/2020 | Liu et al. | |
| 2020/0389474 | A1 | 12/2020 | Levy et al. | |

OTHER PUBLICATIONS

International Search Report and Written Opinion—PCT/US2021/061093—ISA/EPO—dated Feb. 24, 2022; 18 pages.

Qualcomm Technologies INT: "Misbehavior Management and TS 103 759", ETSI Draft, ITSWG5(21) 057007R1, European Telecommunications Standards Institute (ETSI), Sophia-Antipolis Cedex, France, vol. WG ITS WG5 Security, Feb. 8, 2021, pp. 1-22, XP014394212, Retrieved from the Internet: URL: ftp://docbox.etsi.org/ITS/ITSWG5/05-CONTRIBUTIONS/2021/ITSWG5(21)057007r1_Misbehavior_Management_and_TS_103_759.pptx [Retrieved on Feb. 8, 2021] p. 13-p. 15. (22 pages).

* cited by examiner

METHOD AND SYSTEM FOR MISBEHAVIOR DETECTION REPORT MANAGEMENT ROUTING

RELATED APPLICATIONS

This application claims the benefit of priority of U.S. Provisional Application No. 63/137,324 titled "Method and System for Misbehavior Detection Report Management Routing" filed on Jan. 14, 2021, the entire contents of which are hereby incorporated by reference for all purposes.

BACKGROUND

The cellular vehicle-to-everything (C-V2X) protocol serves as the foundation for vehicle-based wireless communications, and may be used to support intelligent highways, autonomous and semi-autonomous vehicles, and improve the overall efficiency and safety of the highway transportation systems. C-V2X defines two transmission modes that, together, provide a 360° non-line-of-sight awareness and a higher level of predictability for enhanced road safety and autonomous driving. A first transmission mode includes direct C-V2X, which includes vehicle-to-vehicle (V2V), vehicle-to-infrastructure (V2I), and vehicle-to-pedestrian (V2P), and that provides enhanced communication range and reliability in the dedicated ITS 5.9 gigahertz (GHz) spectrum that is independent of a cellular network. A second transmission mode includes vehicle-to-network communications (V2N) in mobile broadband systems and technologies, such as third generation wireless mobile communication technologies (3G) (e.g., global system for mobile communications (GSM) evolution (EDGE) systems, code division multiple access (CDMA) 2000 systems, etc.), fourth generation wireless mobile communication technologies (4G) (e.g., long term evolution (LTE) systems, LTE-Advanced systems, mobile Worldwide Interoperability for Microwave Access (mobile WiMAX) systems, etc.), fifth generation wireless mobile communication technologies (5G NR systems, etc.), etc.

IEEE 1609 is the standard under development for vehicle-based communication systems and functionality. Part of that system is the ability for a vehicle to broadcast Basic Safety Messages ("BSM" in the figures) or Cooperative Awareness Messages (CAM) that other vehicles can receive and process to improve traffic safety. The processing of such messages in the transmitting and receiving vehicles occurs in onboard equipment that provide the V2X functionality (referred to herein as "V2X onboard equipment").

In V2X communications, it is important that inaccurate, corrupted, or hacked (i.e., bad) data is detected in order to prevent such inaccurate data from further dissemination. However, as an increasing number of vehicles are equipped to participate in such networks, the volume of potential misbehavior condition data is large and growing at an exponential rate. Thus, the management of such detected misbehavior conditions may be controlled in order to effectively utilize V2X messaging. Misbehavior detection systems are important to perform the function of detection of bad data as well as the generation of misbehavior reports (MBR). MBRs need to be generated, stored locally, and transmitted to a trusted third party for investigation (e.g., Misbehavior Managing Authority). Thus, the integrity and functionality of V2X onboard equipment will be a significant design consideration as V2X systems are fielded.

SUMMARY

Various aspects include methods of managing the generation, storage and transmission of misbehavior detection reports (MBR in the figures) from V2X or V2V onboard equipment to a Misbehavior Managing Authority (MA) after misbehavior conditions are detected by the V2X or V2V onboard equipment. Various aspects may include determining whether to generate a misbehavior report to identify a misbehavior condition based on an aggregated criticality value in response to detection of the misbehavior condition; generating a misbehavior report identifying the misbehavior condition in response to determining to generate a misbehavior report to identify the misbehavior condition; determining whether to store the generated misbehavior report; and transmitting the generated misbehavior report to a Misbehavior Managing Authority.

Some aspects may further include determining whether to transmit the generated misbehavior report to the Misbehavior Managing Authority, wherein transmitting the generated misbehavior report to the Misbehavior Managing Authority is performed in response to determining to transmit the generated misbehavior report.

Some aspects may further include analyzing sensor data using a machine learning model to determine whether a misbehavior condition is detected, in which generating the misbehavior report identifying the misbehavior condition may include generating a misbehavior report that includes one or more of: the machine learning model; an output of the machine learning model; a principal component analysis of the machine learning model; an intermediate representation of the machine learning model; or an identifier of the machine learning model.

Some aspects may further include one or more of: classifying the misbehavior condition that is detected based on a potential safety impact of the misbehavior condition or a level of potential traffic disruption; determining an observed length of the misbehavior condition; determining a number of recurrences of the misbehavior condition; or determining a number of neighboring vehicles experiencing the misbehavior condition, and may further include generating the aggregated criticality value based on one or more of the misbehavior condition classification, the observed length of the misbehavior condition, the number of recurrences of the misbehavior condition, and the number of neighboring vehicles experiencing the misbehavior condition.

Some aspects may further include one or more of: determining a confidence level of detection of the misbehavior condition that is the subject of the misbehavior report; or determining whether additional messages from neighboring vehicles to accompany the misbehavior report; determining whether a network communication link to the misbehavior managing authority is available to transmit the misbehavior report, in which determining whether to store the generated misbehavior report to identify the misbehavior condition may be based on one or more of the confidence level of detection of the misbehavior condition, the number of additional message neighboring vehicles to accompany the misbehavior report, and whether a network communication link to the Misbehavior Managing Authority is available to transmit the misbehavior report.

Some aspects may further include classifying the detected misbehavior condition that is a subject of the generated misbehavior report based on a potential safety impact of the misbehavior condition; assigning an initial weight to the misbehavior report based on the classification of the misbehavior condition; assigning a decay factor to the misbehavior report; and multiplying the assigned initial weight by the decay factor on a regular interval to determine a determined weight of the misbehavior report, wherein determining whether to store the misbehavior report is further based on the determined weight of the misbehavior report.

Some aspects may further include classifying the detected misbehavior condition that is a subject of the generated misbehavior report based on a level of potential traffic disruption; assigning an initial weight to the misbehavior report based on the classification of the misbehavior condition; assigning a decay factor to the misbehavior report; and multiplying the assigned initial weight by the decay factor on a regular interval to determine a determined weight of the misbehavior report, wherein determining whether to store the misbehavior report is further based on the determined weight of the misbehavior report.

Some aspects may further include determining whether an available storage space falls below a storage space threshold level; performing a flush operation in response to determining that the available storage space falls below storage space threshold level, wherein the flush operation deletes stored misbehavior reports based on one of: an order that the misbehavior report is stored, a classification of the misbehavior condition, a number of duplicates stored duplication, and a determined weight of the misbehavior report.

In some aspects, determining whether to transmit the misbehavior report may be based on at least one of: the classification of the misbehavior condition; an order in which the misbehavior report is stored; or a fairness rule. Some aspects may further include transmitting the misbehavior report to a misbehavior preprocessing entity for preprocessing before being sent to the Misbehavior Managing Authority.

Some aspects may further include receiving feedback from the Misbehavior Managing Authority and performing one or more of: adjusting generation parameters that impact the determination to generate the misbehavior report to identify the misbehavior condition in response to the feedback; in response to the feedback, adjusting one or more thresholds for the confidence level of detection of the misbehavior condition, the number of additional message neighboring vehicles to accompany the misbehavior report, and whether a network communication link to the misbehavior managing authority is available to transmit the misbehavior report that are used to determine whether to store the generated misbehavior report; or adjusting transmission parameters that impact the determination to transmit the misbehavior report to the Misbehavior Managing Authority in response to the feedback;

Further aspects include a misbehavior management system including a memory and a processor configured to perform operations of any of the methods summarized above. Further aspects may include a misbehavior management system having various means for performing functions corresponding to any of the methods summarized above. Further aspects may include a non-transitory processor-readable storage medium having stored thereon processor-executable instructions configured to cause a processor of a misbehavior management system to perform various operations corresponding to any of the methods summarized above.

BRIEF DESCRIPTION OF THE DRAWINGS

The accompanying drawings, which are incorporated herein and constitute part of this specification, illustrate exemplary embodiments of the claims, and together with the general description given and the detailed description, serve to explain the features herein.

DETAILED DESCRIPTION

The various embodiments will be described in detail with reference to the accompanying drawings. Wherever possible, the same reference numbers will be used throughout the drawings to refer to the same or like parts. References made to particular examples and implementations are for illustrative purposes, and are not intended to limit the scope of the claims.

In overview, various embodiments include methods and mechanisms for managing the generation, storage, transmission, and preprocessing of misbehavior reports (MBR in the figures) from V2X or V2V onboard equipment following the detection of misbehavior conditions to a managing authority such as a misbehavior managing authority and/or a security credential management system (SCMS).

V2X systems and technologies hold great promise for improving traffic flows and vehicle safety by enabling vehicles to share information regarding their location, speed, direction of travel, braking, and other factors that may be useful to other vehicles for anti-collision and other safety functions. Vehicles equipped with V2X/V2V onboard equipment will frequently (e.g. up to 20 times per second) transmit their vehicle information in packets referred to as Basic Safety Messages (BSM) or Cooperative Awareness Message (CAM). With all V2X equipped vehicles transmitting such BSM/CAM messages, all receiving vehicles have the information required to control their own speed and direction to avoid collisions and efficiently and safely position vehicles with respect to each other. It is envisioned that V2X equipped vehicles may be able to improve traffic flow by safely reducing separation distances, platooning several vehicles together, and avoiding vehicles experiencing breakdowns.

For ease of reference, some of the embodiments are described in this application using a Misbehavior Management System operating within vehicle-to-everything (V2X) terminologies. However, it should be understood that various embodiments encompass any or all of the V2X or vehicle-based communication standards, messages or technologies. As such, nothing in the application should be construed to limit the claims to V2X and Basic Safety Message (BSM) unless expressly recited as such in the claims. In addition, the embodiments described herein discuss onboard equipment to perform V2X communication. Other embodiments are contemplated in which the V2X communication may also include mobile devices, mobile computers and road side units (RSU) equipped to monitor road and vehicle conditions as well as participate in V2X communications.

Figure 1:
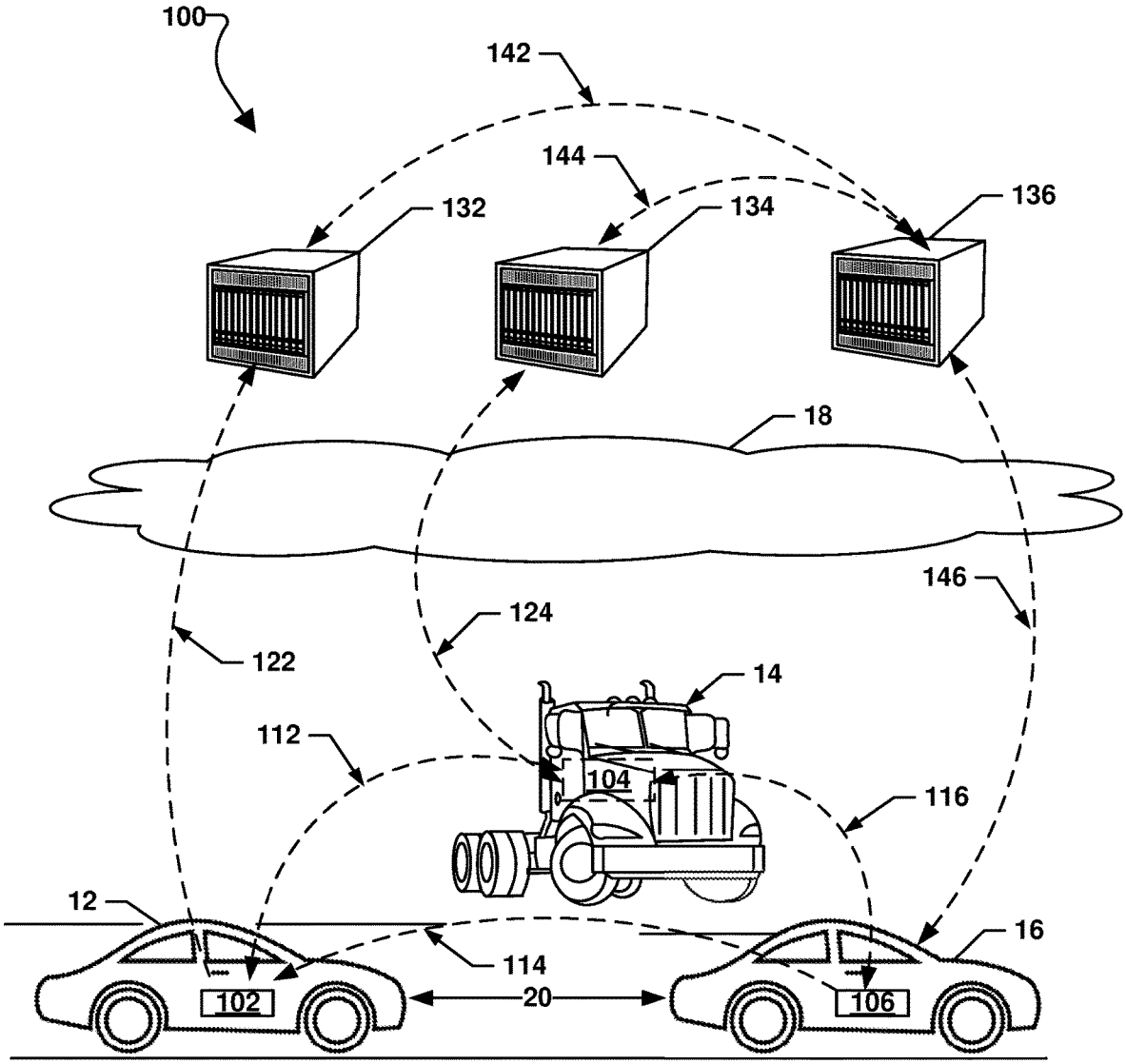
FIG. 1 is a schematic block diagram illustrating a subset of a V2X communication system suitable for implementing various embodiments.

To aid in describing the problem addressed by various embodiments, FIG. 1 illustrates a portion of the V2X system 100 including three vehicles, 12, 14, 16. Each vehicle 12, 14, 16 includes V2X onboard equipment 102, 104, 106, respectively, that are configured to periodically broadcast Basic Safety Messages 112, 114, 116 for receipt and processing by other vehicles' onboard equipment (e.g., 102, 104, 106). By sharing the vehicle location, speed, direction, braking, and other information, vehicles can maintain safe separation and identify and avoid potential collisions. For example, a trailing vehicle 12 receiving Basic Safety Messages 114 from a leading vehicle 16 can determine the speed and location of the vehicle 16, enabling vehicle 12 to match the speed and maintain a safe separation distance 20. By being informed through Basic Safety Messages 114 when the leading vehicles 16 applies the brakes, the V2X equipment 102 in the trailing vehicle 12 can apply brakes simultaneously to maintain the safe separation distance 20 even when the leading vehicle 16 stopped suddenly. As another example, the V2X equipment 104 within the truck vehicle 14 may receive Basic Safety Messages 112, 116 from the two vehicles 12, 16, and thus be informed that the truck vehicle 14 should stop at the intersection to avoid a collision. Each of the vehicle V2X on-board equipment 102, 104, 106 may communicate with one another using any of a variety close proximity communication protocols. In addition, the vehicles may be able to transmit data and information regarding detected Basic Safety Messages as well as detected misbehavior reports to an original equipment manufacturer (OEM) (132, 134) and/or remote misbehavior managing authority 136 via communication links 122, 124 through a communication network 18 (e.g., cellular, WiFi, etc.) The misbehavior report may be transmitted directly to the misbehavior managing authority 136 (e.g., through communication link 146). In other embodiments, the misbehavior report may first be transmitted to a misbehavior report pre-processing unit such as the OEM servers 132, 134 for pre-processing through communication links 122, 124. Then the pre-processed misbehavior report may be transmitted from the misbehavior report pre-processing 132, 134 to the misbehavior managing authority 136 through communication links 142, 144.

Given the criticality of Basic Safety Messages to the safe operation of surrounding vehicles, care should be taken to ensure that Basic Safety Messages are accurate and can be relied upon by other vehicles. One measure used to ensure reliability involves issuing certificates to each V2X onboard equipment that can be used to sign Basic Safety Messages. The certificate issued to V2X onboard equipment does not include a persistent identity for the V2X onboard equipment, and for this reason is typically referred to as a Pseudonym Certificate. A Misbehavior Management System operating within the V2X onboard equipment in nearby vehicles and highway monitoring systems of a basic safety podcast can confirm the authenticity of the V2X onboard equipment issuing the Basic Safety Message by verifying the signature on the broadcast messages. V2X onboard equipment receiving a Basic Safety Message can verify the signature using a public key. To guard against hacking or interference with the V2X system operations, V2X onboard equipment may be configured to ignore any received Basic Safety Message that has been signed using an expired or invalid certificate.

While signing Basic Safety Messages using the certificate issued to V2X onboard equipment guards against attempts to inject false Basic Safety Messages, the signature verification process may not detect when inaccurate Basic Safety Messages are generated by malfunctioning V2X onboard equipment using a legitimate certificate. Various equipment malfunctions may cause a V2X onboard equipment to produce incorrect Basic Safety Messages. For example, faults in navigation sensors, speed sensors, and/or cabling from such sensors to the V2X onboard equipment may result in inaccurate reporting of vehicle position (e.g., in an incorrect lane or larger error) or speed. It is also possible that a V2X onboard equipment may be maliciously altered to produce incorrect Basic Safety Messages that are signed using a legitimate certificate. Both cases are referred to as misbehavior.

In many cases, a receiving Misbehavior Management System may detect the misbehavior via misbehavior detection in onboard processing. Incorrect Basic Safety Messages may be recognized by the Misbehavior Management System operating in other vehicles when information contained in such messages conflicts with trustworthy information available to the V2X onboard equipment. For example, a Misbehavior Management System may recognize that the position information in a received Basic Safety Message is incorrect when the reported location of the reporting vehicle overlaps with the position of the vehicle receiving the Basic Safety Message. As another example, a Misbehavior Management System may recognize that the velocity information in received Basic Safety Message is incorrect when the velocity is inconsistent with the velocity of the equipment's own vehicle and surrounding vehicles. Other methods of recognizing incorrect Basic Safety Messages may be used.

To ensure the integrity and reliability of the V2X systems, the Misbehavior Management System may be configured to inform other vehicles and highway systems or authorities of detected incorrect Basic Safety Messages by transmitting messages that notify other systems of the detected issues. In conventional systems, the receiving V2X onboard equipment may automatically produce a misbehavior report (MBR in the figures) or a Misbehavior Detection Report. Each misbehavior report may include the Pseudonym Certificate of the misbehaving V2X onboard equipment that signed the incorrect Basic Safety Message. A Misbehavior Management System that detected the misbehavior may be configured to send the Misbehavior Detection Report to a specific network backend entity for processing, which is referred to herein as the Misbehavior Authority (MA) of an SCMS. The reporting V2X onboard equipment is typically configured by the OEM, so the Misbehavior Report Catcher is typically operated by, or on behalf of, the OEM of the reporting V2X onboard equipment.

Misbehavior detection reports may be collected by a misbehavior authority, which may be an entity run by any of a variety of parties, such as a government agency, an independent third-party agency or service provider, and/or an OEM. A misbehavior authority may be configured to take actions to protect the reliability and integrity of the V2X systems and equipment. For example, a misbehavior authority may blacklist the certificates of misbehaving V2X onboard equipment so that other V2X onboard equipment can know to ignore Basic Safety Messages containing blacklisted certificates. Decentralized misbehavior authorities may also inform certificate registration authorities of certificates so that appropriate actions can be taken by the corresponding Registration Authority.

The term misbehaving V2X onboard equipment is used herein for the V2X onboard equipment to which misbehavior is attributed to in a Misbehavior Detection Report. However, in some cases another component or entity, and not the attributed V2X onboard equipment, could be misbehaving using messages or credentials obtained from the V2X onboard equipment. For example, a faulty sensor or equipment in the same vehicle as the attributed V2X onboard equipment may be the cause of erroneous information in a Basic Safety Message resulting in a misbehavior detection, although there are other scenarios in which an entity outside the vehicle may be responsible for transmission of incorrect Basic Safety Messages.

An entity, such as an OEM, may use of misbehavior reports for a variety of reasons. For example, an OEM of an V2X onboard equipment may be interested in seeing information regarding the misbehavior reports for misbehavior attributed to that V2X onboard equipment. In some cases, the OEM may want the information purely for recording statistics. In other cases, the OEM may take appropriate steps including, but not limited to, any of the following: attempting to fix errors in the V2X onboard equipment implementation; replacing the V2X onboard equipment; disabling the V2X onboard equipment; notifying the owner that the vehicle should be brought in for maintenance; deleting certificates from the V2X onboard equipment; placing some of the V2X onboard equipment certificates on a revocation list; issuing new certificates to the V2X onboard equipment. The OEM may perform such operations over the air in some cases, while physical access to the V2X onboard equipment is required in other cases.

As more and more vehicles are equipped with V2X equipment, the volume of possible detected misbehaviors is growing at an exponential rate. If a misbehavior report is to be generated in response to every detected misbehavior, the OEM and/or any misbehavior authority will be overwhelmed with misbehavior reports. Thus, it may be necessary to manage whether to generate misbehavior reports each time a misbehavior condition is detected based on an assigned criticality of the detected misbehavior condition. Moreover, in instances in which a Misbehavior Management System operating within the V2X equipment determines to the generate a misbehavior report, the Misbehavior Management System may need to manage whether to store the misbehavior report and/or whether to transmit the misbehavior report to a managing authority in a SCMS. Again, the determination as to whether to store the misbehavior report may be based on the assigned criticality to the detected misbehavior condition. As the Misbehavior Management System becomes more sophisticated, the Misbehavior Management System may receive feedback from the misbehavior managing authority that provides the Misbehavior Management System with feedback that may allow the Misbehavior Management System to refine and improve the management of the misbehavior events. In particular, the feedback may allow the Misbehavior Management System to refine instances in which to generate a misbehavior report in response to detecting a misbehavior, storing the generated misbehavior report and/or transmitting the misbehavior report to a misbehavior managing authority. In some embodiments, the feedback may allow the Misbehavior Management System to refine the level of criticality that may be assigned to detected misbehavior conditions.

In V2X communication, it is beneficial to detect bad data to prevent spread of useless data among vehicles. Misbehavior detection system plays this role and, as a reaction after detection, can generate misbehavior reports, misbehavior reports may need to be generated, stored locally, and transmitted to a trusted third party for investigation (e.g., Misbehavior Authority in SCMS). The rules for generation, storage and transmission are not trivial and may be defined such that utility is maximized and overhead minimized. For example, a misbehavior detection system should not generate a misbehavior report for every single misbehavior of the same type coming from the same remote vehicle but could create one report and append an "occurrence" value. This would save generation time (and I/O operations), local storage space, and decrease the number of misbehavior reports to transmit and to be checked by the MA. The ITS community is lacking such set of rules/algorithms for misbehavior report management.

Various embodiments disclosed herein provide methods and mechanisms for managing misbehavior reports after the misbehavior conditions have been detected. The various embodiments may determine instances in which it is appropriate to generate a misbehavior report based on an assigned criticality in response to a misbehavior condition is detected. The various embodiments may also determine when it is appropriate to store the generated misbehavior report when a misbehavior report is generated. The determination to store a misbehavior report may also be based on the level of criticality that is assigned to the underlying misbehavior condition that is detected and the subject of the misbehavior report. The various embodiments may also determine when it is appropriate to delete a misbehavior report that was previous stored. The various embodiments may also determine when it is appropriate to transmit a misbehavior report to a managing authority. In some embodiments in order to more efficiently utilize the information in the misbehavior report, the Misbehavior management system may preprocess the data contained in misbehavior report.

Various embodiments may include operations to receive feedback from managing authorities in order to modify or optimize the management of misbehavior reports. This may include a refinement of the assigned criticality level.

The various embodiment Misbehavior Management System may be deployed on any device capable of receiving directly or indirectly V2X messages. Thus, the various embodiments disclosed herein may work in an onboard unit mounted within a vehicle, in smartphone, roadside unit, or even in the cloud, to name a few.

In order provide context and background for the various embodiments, the following background on the IEEE 1609 misbehavior report processing system is provided. The following description is high level and provided primarily to explain the roles of various authorities and functionalities envisioned for interactions between various entities with V2X onboard equipment. Various embodiments are not limited to the following misbehavior report management processes.

The sending V2X equipment (e.g., on-board unit (OBU), RSU, ASD) may detect misbehavior conditions and determine whether to generate, store, and/or transmit misbehavior reports to a misbehavior managing authority (MA) that may also provide such reports to an SCMS. In order to authenticate misbehavior conditions, misbehavior reports, and Basic Safety Messages, each sending V2X equipment may attach a public key signature to each misbehavior conditions, misbehavior reports, and Basic Safety Messages, which can be verified by the public signing key in a Pseudonym Certificate which has been issued to the sending V2X onboard equipment.

Figure 2:
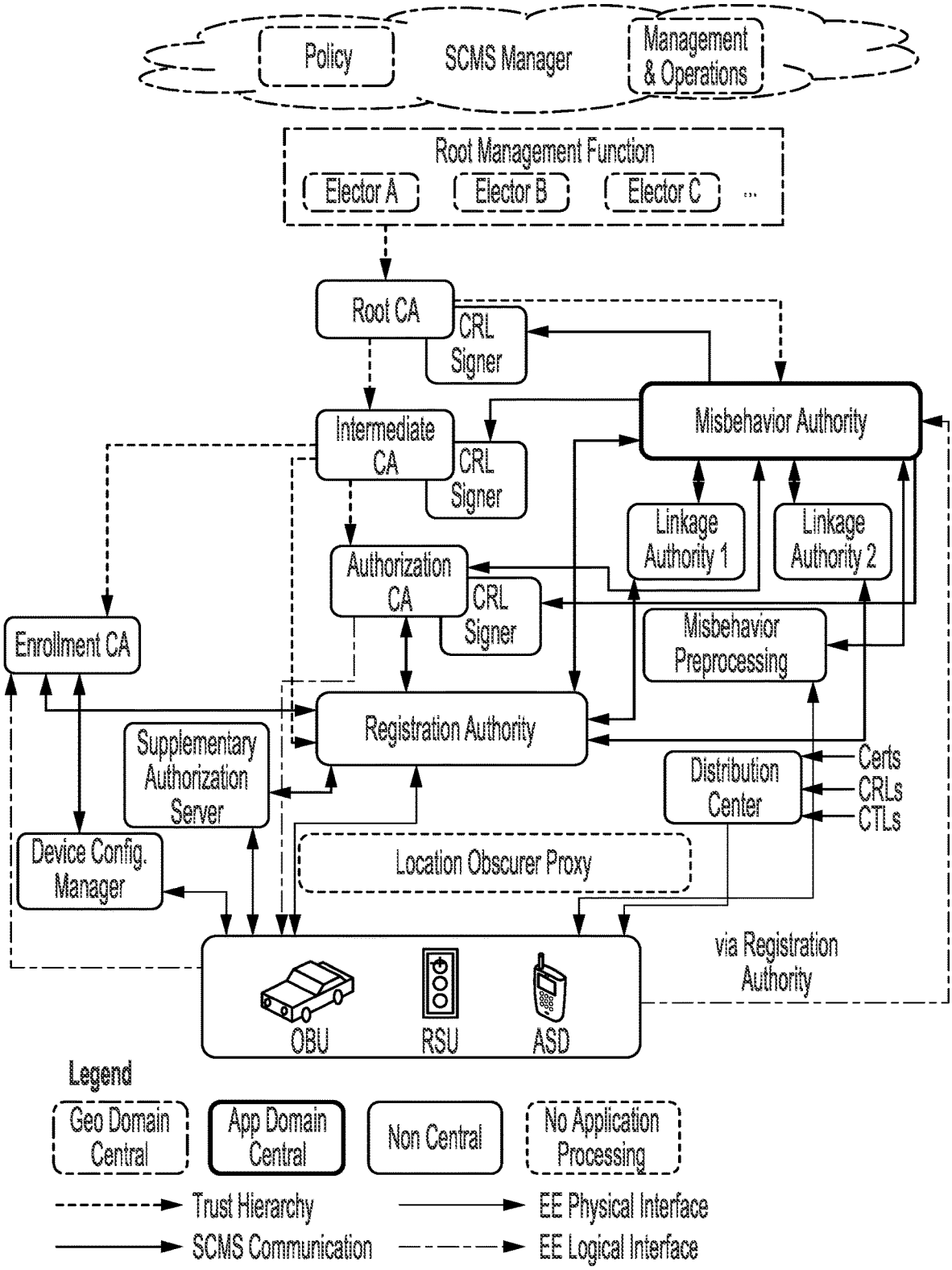
FIG. 2 is a component diagram of a misbehavior management network for managing misbehavior reports.

FIG. 2 diagrams various entities and relations between entities involved in communicating misbehavior reports between a misbehavior managing authority and individual V2X onboard equipment.

Figure 3:
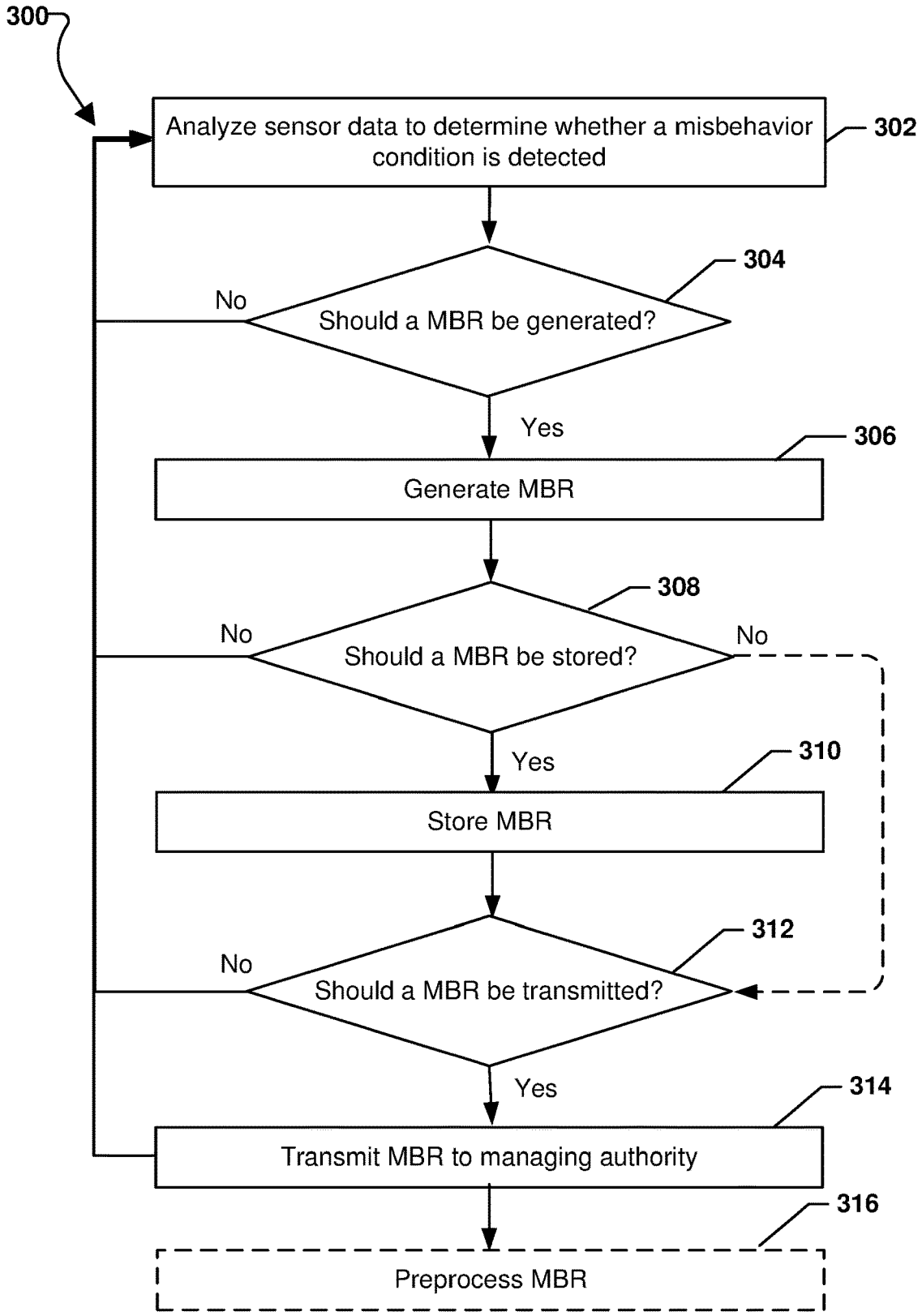
FIG. 3 is process flow diagrams of example methods of managing the generation, storage and transmission of misbehavior reports by a Misbehavior Management System.

FIG. 3 illustrates a method 300 of basic operations involved in managing the generation, storage, and transmission of misbehavior reports from a misbehavior management system of V2X equipment and misbehavior managing authority according to various embodiments. With reference to FIGS. 1-3, the operation of the method 300 may be performed by a misbehavior management system (e.g., 102, 104, 106), such as by a processor configured with processor-executable instructions to perform operations of the method 300.

In block 302, the misbehavior management system included in on-board V2X equipment 102, 104, 106, may monitor the various sensor data or their respective vehicles, 12, 14, 16 to determine whether a misbehavior condition is detected. In some embodiments, the V2X equipment may also include roadside units and/or other mobile units that may be able to monitor and observe the behavior of other respective vehicles to determine whether a misbehavior condition exists. For example, the V2X equipment may receive a Basic Safety Message from another vehicle that is inconsistent with the observations that the V2X equipment may make of other vehicles. As an example, the V2X equipment 102 on-board in vehicle 12 may receive a basic safety message (BSM) from the V2X equipment 106 on-board in vehicle 16 that vehicle 16 is initiating an emergency braking operation. However, the Misbehavior management system of V2X equipment 102 on-board in vehicle 12 may observe that vehicle 16 is not decelerating or applying an emergency brake. In such situations, the V2X equipment 106 on-board in vehicle 16 may detect a misbehavior condition as the BSM that an emergency braking operation is occurring is inconsistent with other sensor data that the Misbehavior management system of V2X equipment 106 on-board in vehicle 16 is monitoring. In addition, the Misbehavior management system of V2X equipment 102 on-board in vehicle 12 that receives the BSM from the Misbehavior management V2X equipment 106 on-board in vehicle 16 may also detect a misbehavior condition, as the BSM received from the V2X equipment 106 on-board in vehicle 16 is inconsistent with the observations made by the V2X equipment 102 on-board in vehicle 12.

While both the V2X equipment 106 on-board in vehicle 16 as well as the V2X equipment 102 on-board in vehicle 12 may detect a misbehavior condition, each V2X equipment 102, 106 may make a determination whether a misbehavior report should be generated in determination block 304, and if so, what evidence to collect and append to the generated misbehavior report. The decision to generate a misbehavior report after detecting a misbehavior condition may be based on a number of factors. As discussed in more detail below with reference to FIGS. 4A and 4B, the decision to generate a misbehavior report may be based on the (i) seriousness of the misbehavior detected (due to potential safety impact, or level of potential road traffic disruption), (ii) length of observed misbehavior (this helps differentiating transient fault to persistent misbehavior), (iii) number of times the remote vehicle has been detected as misbehaving (i.e. this helps covering sporadic misbehavior), (iv) number of neighboring vehicles (with different certificate) detected as performing similar misbehavior (this helps aggregating and reporting a larger issue), or (v) simply after at least one detector was triggered.

In response to determining that a misbehavior report should be generated (i.e., determination block 304="Yes"), the misbehavior report may be generated in operation 306. Upon generation of the misbehavior report, the V2X equipment may determine whether the generated misbehavior report should be stored and/or transmitted to a misbehavior managing authority. In response to determining that a misbehavior report should not be generated (i.e., determination block 304="No"), the V2X equipment processor may return to monitor the various sensor data to determine if a misbehavior condition is detected in block 302.

In determination block 308, the Misbehavior management system may determine whether the misbehavior report should be stored in memory. The decision to store a misbehavior report after the report is generated may be based on an assigned level of criticality that is in turn based on a plurality of criteria. As discussed in more detail below with reference to FIGS. 5A and 5B, the decision to store the generated misbehavior report may also depend on an assigned level of criticality that is in turn based on a plurality of criteria that may include: (i) the confidence level of detection of misbehavior condition. (ii) the determined message set size (e.g. misbehavior detected but requires a certain number of messages from neighboring devices), (iii) the determined storage required for blacklisting approach (note that storing a hash of the remote vehicle certificate in a counting Bloom filter (or Cuckoo filter) would work), (iv) whether a network connection to SCMS/PKI available.

In response to determining that a misbehavior report should be stored (i.e., determination block 308="Yes"), the misbehavior report may be stored in a memory storage of the Misbehavior management system in block 310. Upon storage of the misbehavior report, the Misbehavior management system may determine whether the generated misbehavior report should be transmitted to a misbehavior managing authority in determination block 312.

In response to determining that a misbehavior report should not be stored (i.e., determination block 312="No"), the Misbehavior management system may return to monitor the various sensor data to determine if a misbehavior condition is detected in block 302.

In some embodiments, even if the Misbehavior management system determines that a misbehavior report should not be stored (i.e. determination block 308="No"), the Misbehavior management system may optionally determine whether to transmit the misbehavior report to a misbehavior managing authority in determination block 312 before again monitoring the various sensor data to determine if a misbehavior condition is detected in block 302. As shown in FIG. 3, in the optional dashed line, if the Misbehavior management system determines that a misbehavior report should not be stored (i.e., determination block 308="No"), the Misbehavior management system may optionally determine whether the generated misbehavior report may be transmitted to a misbehavior managing authority in optional determination block 312. The Misbehavior management system may determine whether to transmit the misbehavior report to the misbehavior managing authority.

In response to determining that the misbehavior report should be transmitted (i.e., determination block 312="Yes"), the misbehavior report may be transmitted to a misbehavior managing authority in block 314. After the misbehavior report is transmitted, the Misbehavior management system may return to monitor the various sensor data to determine if a misbehavior condition is detected in block 302.

In some embodiments, the Misbehavior management system may use artificial intelligence, neural network and/or machine learning techniques (referred to herein generally as a machine learning model") to detect the occurrence of a misbehavior condition. A machine learning models may be used by the Misbehavior management system to analyze a copious amount of data from a large number of sensors and data sources to obtain an indication or probability of whether a misbehavior condition exists. In embodiments in which the Misbehavior management system uses a machine learning model to detect misbehavior conditions, the Misbehavior management system may generate a misbehavior report that includes information about and/or generated by the machine learning model. This may reduce the amount of data to contained in a misbehavior report, stored with the misbehavior report, and/or transmitted in the compared to including all data related to or characterizing the detected misbehavior condition. Thus, in embodiments in which the Misbehavior management system uses a machine learning model to detect misbehavior conditions, the Misbehavior management system may be configured to generate a misbehavior report that includes one or more of: the machine learning model; an output of the machine learning model; a principal component analysis of the machine learning model; an intermediate representation of the machine learning model; or an identifier of the machine learning model. In embodiments in which the misbehavior report includes an identifier of the machine learning model, the misbehavior managing system operating on the V2X equipment and the misbehavior managing authority may have previously shared machine learning models and agreed on an index value.

In addition, in embodiments in which there may be a number of stored misbehavior reports, the Misbehavior management system may the priority order in which the misbehavior reports are transmitted. For example, the priority order may be based on the determined weight for each misbehavior report (i.e. highest priority first). As discussed in more detail below with reference to FIG. 6, the misbehavior reports may be assigned a weight that may vary depending on the relative age of the misbehavior report. If competing misbehavior reports have the same determined weight value, the stored order of the misbehavior report may be used to determine the transmission priority order. For example, a first in-first out (FIFO) or last in-first out (LIFO) scheme may be used, or if the determined weight is disassociated from a classification or seriousness of the underlying misbehavior condition, the assigned classification or seriousness value may be used as a priority order parameter.

Another transmission priority rule may be a "fairness" rule in which an ego vehicle may transmit a misbehavior report that reports on its neighboring vehicles (i.e., vehicles with different IDs). This transmission priority rule may ensure that an ego vehicle does not only report one specific neighboring vehicle all the time. The fairness may be implemented using round-robin scheduling technique. For example, an ego vehicle may detect misbehavior conditions occurring within itself as well as misbehavior conditions occurring in neighboring vehicles. With reference to FIG. 1, a vehicle 12 (ego vehicle) may detect misbehavior conditions that occur within the vehicle 12 as well as misbehavior conditions occurring in vehicles 14 and 16. The misbehavior management system operating within the V2X equipment 102 may generate a series of misbehavior reports related to the misbehavior conditions occurring in each of vehicle 12, vehicle 14 and vehicle 16. In an example, the misbehavior management system operating within the V2X equipment 102 may generate three (3) separate misbehavior reports related to misbehaviors occurring within each of vehicles 12, vehicle 14 and vehicle 16. The misbehavior reports may be identified as $MBR_{12-1}$, $MBR_{12-2}$, $MBR_{12-3}$, $MBR_{14-1}$, $MBR_{14-2}$, $MBR_{14-3}$, $MBR_{16-1}$, $MBR_{16-2}$, and $MBR_{16-3}$. Embodiments that implement a "fairness" rule may ensure that the misbehavior reports related to each different vehicle are equally reported within a given uplink budget. Thus, the reports may be transmitted in an order such as $MBR_{12-1}$, $MBR_{14-1}$, $MBR_{16-1}$, $MBR_{12-2}$, $MBR_{14-2}$, $MBR_{16-2}$, $MBR_{12-3}$, $MBR_{14-3}$, and $MBR_{16-3}$.

The generated misbehavior reports may be transmitted to a central "Misbehavior Managing Authority" (MA) which processes the misbehavior reports. The Misbehavior Managing Authority may perform further analysis on the misbehavior reports and decide which enforcement activities to carry out based on the analysis. In conventional Misbehavior management systems, the Misbehavior Managing Authority may not possess good knowledge regarding the trustworthiness of the received misbehavior reports or about their capabilities, because the reporting Misbehavior management systems may not want to reveal proprietary information about their capabilities or what they've observed, and because cryptographic overhead and processing redundant data may be a burden on the Misbehavior Managing Authority.

In some embodiments, the misbehavior report may be transmitted to a Misbehavior Preprocessing entity (also called Misbehavior Processor—shortened MBRPre) in block 316, for preprocessing before being sent to the Misbehavior Managing Authority (MA). For example, the MBRPre (e.g., 132, 134) may be the OEM (for reports received from vehicles), or the mobile network operator (for reports received from smartphones). A key property of the MBRPre may be that it has an individual relationship with the V2X equipment 102, 104, 106 and is trusted by the central misbehavior managing authority 136. This relationship enables the misbehavior report processor (e.g., 132, 134) to update misbehavior managing systems operating within the V2X equipment so that the misbehavior managing systems operating on the V2X equipment may send proprietary format misbehavior reports to their MBPre (e.g., 132, 134). This relationship also allows MBPres to update the misbehavior report format, or to create aggregate or statistical reports, as well as potentially forwarding the original report material. Thus, in some embodiments, a misbehavior report that is first sent from V2X equipment 102, 104, 106 to a MBPre (e.g., 132, 134) may contain more information than in instances in which the V2X equipment 102, 104, 106 sends the misbehavior report directly to the MA 136. For example, the misbehavior report that is first sent from V2X equipment 102, 104, 106 to a MBPre (e.g., 132, 134) may contain specific or proprietary information that allows the MBPre 132, 134) to monitor and/or calibrate sensors and/or record proprietary information related to the operation of the vehicle. It may be unnecessary for the MA 136 to receive such information. Thus, in some embodiments, such additional information may be stripped out or removed from the misbehavior report before the misbehavior report is relayed on to the MA 136.

For example, an on-board equipment (e.g., 102, 104, 106) within a vehicle 12, 14, 16 may detect a position overlap misbehavior when two neighboring vehicles equipped with V2X are observed with overlapping locations. The vehicle's OEM may be aware of a faulty GNSS receiver and hence may disregard or drop the misbehavior report resulting from this detected condition in order to avoid sending faulty misbehavior reports to the central misbehavior managing authority. As another example, if the OEM know that the GNSS is not faulty, the OEM could augment the misbehavior report with telematics data to provide richer evidence to the misbehavior managing authority (e.g., 136).

Figure 4A:
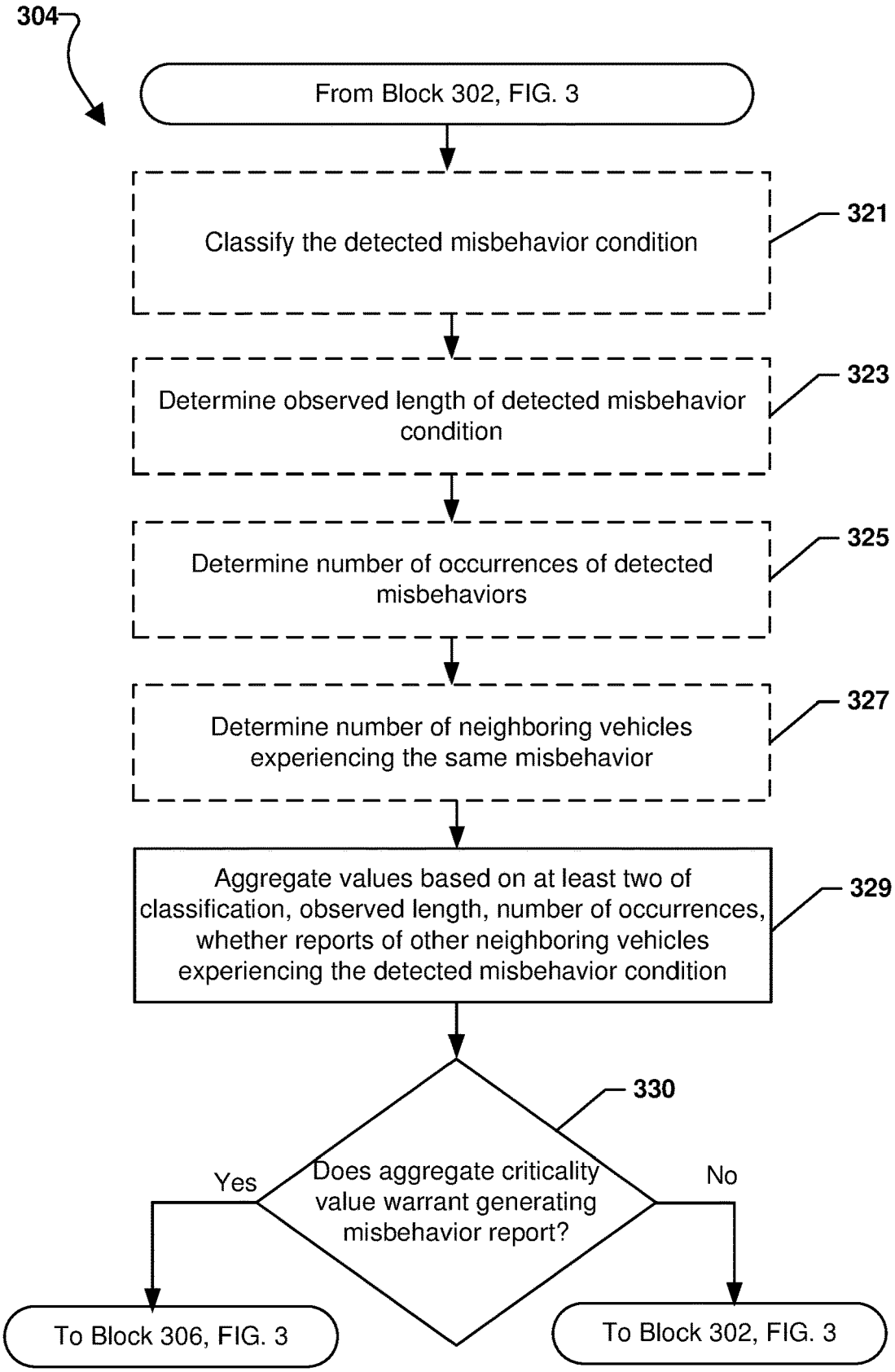
FIGS. 4A and 4B are process flow diagrams of example methods of determining whether to generate misbehavior reports by a Misbehavior Management System.

FIG. 4A illustrates an embodiment method of determining whether a misbehavior report should be generated based on an assigned criticality level of the underlying misbehavior condition in determination block 304. The assigned criticality level may be based on a plurality of criteria. For example, the assigned criticality level may be based on a classification of the underlying misbehavior condition that is the subject of the proposed misbehavior report, the observed length of the underlying misbehavior condition, the number of occurrences of the underlying misbehavior condition, as well as the number of neighboring vehicles that may experience the underlying misbehavior condition. In order to conserve network resources, the generation of a misbehavior report may be limited to underlying misbehavior conditions that have a higher aggregated criticality value. By limiting the generation of misbehavior reports to more important (i.e., more critical) underlying misbehavior conditions, the overall system may be improved by focusing on misbehavior conditions that either may impact user safety or are prevalent enough to impact a larger number of V2X system participants.

With reference to FIG. 4A, after the Misbehavior management system detects that a misbehavior condition has occurred in block 302, the Misbehavior management system may determine whether to generate a misbehavior report based on whether the aggregated criticality value is above a threshold. The aggregated criticality value may be based on one or more of the misbehavior condition classification, the observed length of the misbehavior condition, the number of recurrences of the misbehavior condition, and the number of neighboring vehicles experiencing the misbehavior condition. Thus, FIG. 4A illustrates a number of optional classification and determination blocks that may be aggregated to generate the aggregated criticality value. Various embodiments may use any, some, or all of the optional classification and determination operations. For example, the Misbehavior management system may classify the detected misbehavior condition in block 321. For example, the misbehavior condition may be classified into one of two categories, such as a misbehavior that is related to a potential safety issue or a misbehavior that is related to potential road traffic disruption. An appropriate value may be assigned to the misbehavior condition to identify it as either misbehavior that is related to a potential safety issue or a misbehavior that is related to potential road traffic disruption.

In the example discussed above, the Misbehavior management system of the V2X equipment 102 on-board in vehicle 12 may receive a basic safety message (BSM) from the V2X equipment 106 on-board in vehicle 16 that vehicle 16 is initiating an emergency braking operation. However, other sensor data as well as the observations made by other external V2X equipment such as in other vehicles or roadside units may contradict the emergency braking operation. Such a misbehavior condition could cause other vehicles to unnecessarily perform a sudden braking operation that leads to an accident. Thus, the misbehavior condition may be classified as being related to a potential safety issue.

In another example, a vehicle's global positioning system (GPS) may erroneously determine the vehicle's position. By calculating the vehicle's position erroneously, a particular road/street may erroneously report more vehicle's traveling on the road street than are actually traveling on the road/street. Such an erroneous report may be related to potential road traffic disruption. Still further the erroneously determined vehicle location may be related to a potential safety issue. For example, if the vehicle GPS erroneously determines and reports the vehicle's position to be in the wrong lane of travel (i.e., on the wrong side of the road/street), other vehicles may be directed to take evasive maneuvers to avoid the "phantom" vehicle that erroneously reports its location. This could lead to a potential safety issue.

While in some embodiments, misbehavior conditions may be classified as either misbehavior that is related to a potential safety issue or a misbehavior that is related to potential road traffic disruption, in other embodiments, the misbehavior condition may be assigned a value on a singular sliding scale. For example, misbehavior conditions that are related to safety issues that may result in serious harm may be assigned a high value. Misbehavior conditions that are related only to road traffic disruptions may be assigned a low value. Other misbehavior conditions that may be related to both potential safety issue and related to potential road traffic disruption may be assigned an intermediate value based on the misbehavior condition's relative potential harm vis-a-vis inconvenience.

In block 323, the Misbehavior management system may determine the observed length of the misbehavior condition and assign a value based on the observed length. As an example, in some instances, the misbehavior condition may be a temporary anomaly causing the detected misbehavior. However, in other instances the misbehavior condition may be persistent. For example, if a misbehavior condition only occurs for a short period of time in a particular location, it may be evidence of a malicious hack in a particular area that impacts vehicles traveling in a particular area. In contrast, a persistent misbehavior may be a result of a faulty sensor that continually reports erroneous data. Whether a misbehavior condition is short in duration or long in duration may be significant to a Misbehavior management system. Depending on how the Misbehavior management system decides to respond to the observed length of the misbehavior condition (i.e., long vs. short) may be subjective. In either case, the observed length of the detected misbehavior may be assigned a value for consideration into whether to generate a misbehavior report or not.

In block 325, the Misbehavior management system may determine the number of occurrence of detected misbehaviors and assign a value based on the number of occurrences of the detected misbehavior. For example, it the Misbehavior management system detects the same misbehavior consistent repeatedly, it may indicate that a sensor requires repair or replacement. Therefore, multiple of occurrences of the detected misbehavior condition may be assigned a value (higher or lower) that may result in a determination that a misbehavior report is generated.

In block 327, the Misbehavior management system may determine the number of neighboring vehicles experiences the misbehavior. As discussed in the example above, the Misbehavior management system of the V2X equipment 102 on-board in vehicle 12 may receive a basic safety message (BSM) from the V2X equipment 106 on-board in vehicle 16 that vehicle 16 is initiating an emergency braking operation. However, other sensor data as well as the observations made by other external V2X equipment such as in other vehicles or roadside units may contradict the emergency braking operation. The Misbehavior management system of vehicle 12 may receive V2X communications from the Misbehavior management system of the V2X equipment 106 on board vehicle 16 informing the V2X equipment 102 on-board in vehicle 12 of the observations made by the V2X equipment 106 on board vehicle 16. Such indications of neighboring vehicles on the same detected misbehavior condition may further support the confidence level of the Misbehavior management system of vehicle 12 that the misbehavior condition was accurately detected. Such indications from neighboring vehicles may be recorded and added as evidence of the detection of the misbehavior condition. The Misbehavior management system may assign a value to the misbehavior condition based on the number of neighboring vehicles experiencing the same misbehavior. For example, a higher number of other neighboring vehicles experiencing the same misbehavior may boost the confidence that the misbehavior condition is accurately detected.

In block 329, the values that are assigned by the Misbehavior management system based on the classification of the detected misbehavior condition in block 321, the observed length of the detected misbehavior in block 323), the number of occurrences of the detected misbehaviors in block 325, and the number of neighboring vehicles that experience the misbehavior condition th block 327 may be aggregated to determine an aggregated criticality value for the detected misbehavior condition. As noted above, the aggregated criticality value may include any, some, or all of the misbehavior condition classification, the observed length of the misbehavior condition, the number of recurrences of the misbehavior condition, and the number of neighboring vehicles experiencing the misbehavior condition.

In determination block 330 the Misbehavior management system may determine whether the aggregated criticality value exceeds a threshold value. In some embodiments, the values assigned to each of the criteria used to determine whether to generate a misbehavior report may be lower values for more serious conditions that warrant the generation of a misbehavior report. In such embodiments, an aggregate value that is lower than a threshold value would exceed the threshold value. In other embodiments, the values assigned to each of the criteria used to determine whether to generate a misbehavior report may be higher values for more serious conditions that warrant the generation of a misbehavior report. In such embodiments, an aggregate value that is higher than a threshold value would exceed the threshold value.

In response to determining that the aggregated criticality value exceeds the threshold value (i.e., determination block 330="Yes"), the Misbehavior management system may generate a misbehavior report in block 306.

In response to determining that the aggregated criticality value does not exceed a threshold value (i.e., determination block 330="No"), the Misbehavior management system may again monitor for other misbehavior conditions in block 302.

Figure 4B:
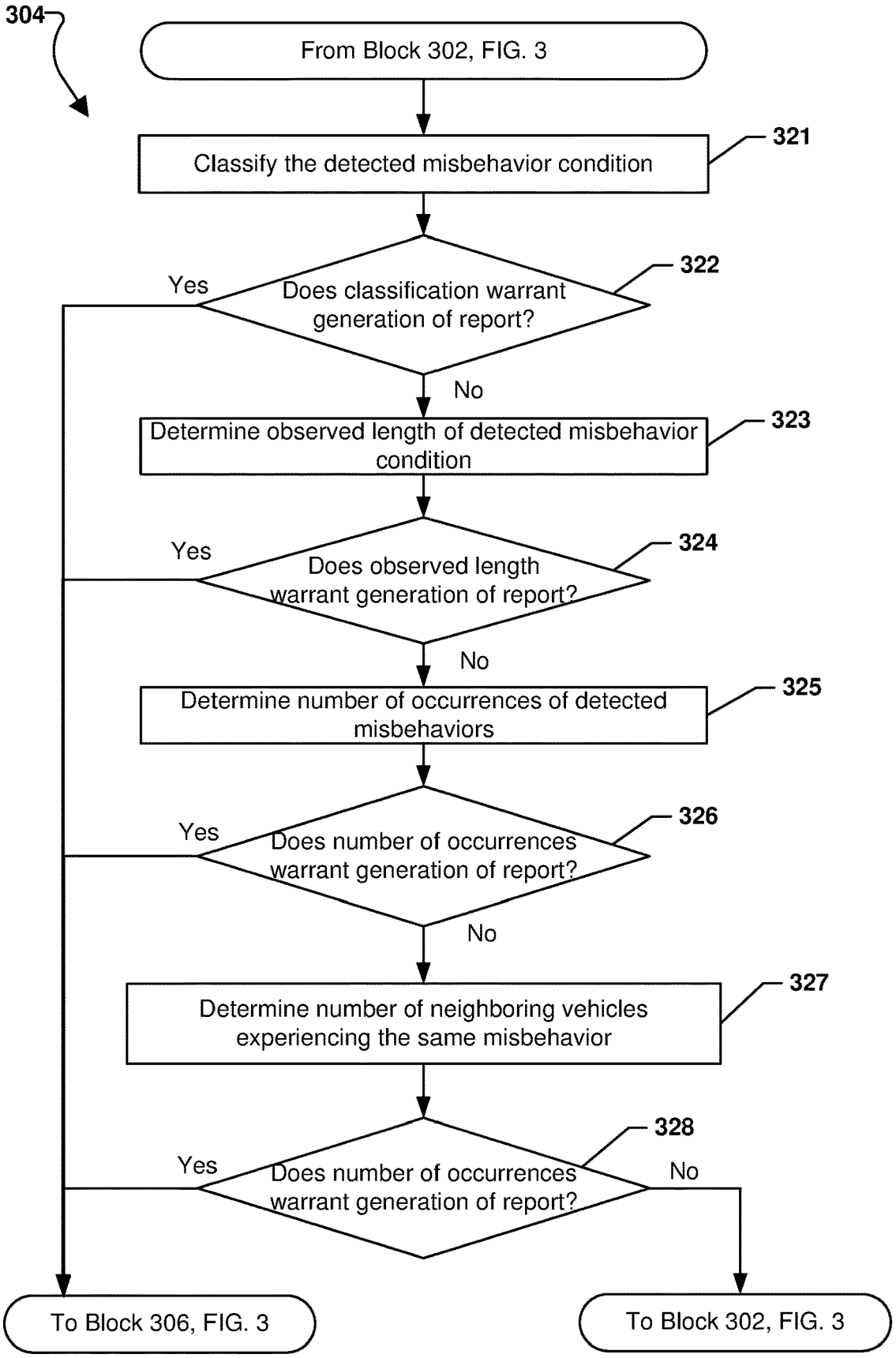

Referring to FIG. 4B, an alternative embodiment is illustrated for determining whether to generate a misbehavior report in determination block 304 in response to detection of a misbehavior condition. With reference to FIGS. 1-4B, the alternative embodiment may also perform the operations of classifying the detected misbehavior condition in block 321, determining the observed length of the detected misbehavior in block 323, determining the number of occurrences of the detected misbehaviors in block 325, and determining the number of neighboring vehicles that experience the misbehavior condition in block 327. However, in contrast to the embodiment illustrated in FIG. 4A, after each operation of classifying or determining, a separate determination may be made as whether the assigned value for each criteria exceeds a threshold value such that a misbehavior report may be generated.

For example, after classifying the detected misbehavior condition in block 321, and assigning a value based on the classification of the detected misbehavior condition, the Misbehavior management system may determine whether the assigned value exceeds a threshold in determination block 322.

If the assigned value based on the classification exceeds a threshold (i.e., determination block 322="Yes"), the Misbehavior management system may generate a misbehavior report in block 306. If the value assigned based on the classification of the detected misbehavior does not exceed a threshold (i.e., determination block 322="No"), the Misbehavior management system may perform the operations of block 323 as described.

After determining the observed length of the detected misbehavior condition in block 323, and assigning a value based on the observed length of the detected misbehavior condition, the Misbehavior management system may determine whether the assigned value based on the observed length exceeds a threshold in determination block 324.

In response to determining that the assigned value exceeds a threshold (i.e., determination block 324="Yes"), the Misbehavior management system may generate a misbehavior report in block 306. In response to determining that the value assigned based on the observed length of the detected misbehavior does not exceed a threshold (i.e., determination block 324="No"), the Misbehavior management system may perform the operations of block 325 as described.

After determining the number of occurrences of the detected misbehavior condition in block 325, and assigning a value based on the number of occurrences of the detected misbehavior condition, the Misbehavior management system may determine whether the assigned value based on the number of occurrences exceeds a threshold in determination block 326.

In response to determining that the assigned value exceeds a threshold (i.e., determination block 326="Yes"), the Misbehavior management system may generate a misbehavior report in block 306. In response to determining that the value assigned based on the number of occurrences of the detected misbehavior does not exceed a threshold (i.e., determination block 326="No"), the Misbehavior management system may determine the number of neighboring vehicles that experience the misbehavior condition in block 327.

After determining the number of neighboring vehicles experiencing the same detected misbehavior condition in block 327, and assigning a value based on the number of neighboring vehicles experiencing the same detected misbehavior condition, the Misbehavior management system may determine whether the assigned value based on the number of neighboring vehicles experiencing the same detected misbehavior condition exceeds a threshold in determination block 328.

In response to determining that the assigned value exceeds a threshold (i.e., determination block 328="Yes"), the Misbehavior management system may generate a misbehavior report in block 306. In response to determining that the value assigned based on the n number of neighboring vehicles experiencing the same detected misbehavior condition does not exceed a threshold (i.e., determination block 326="No"), the Misbehavior management system may again monitor for other misbehavior conditions in block 302 as described.

After misbehavior report generation in block 306, the Misbehavior management system may determine whether to store the misbehavior report in local memory in determination block 308 or to transmit the misbehavior report in determination block 312), or most likely both. In circumstances in which the vehicle does not have network connectivity to transmit its misbehavior report(s) the Misbehavior management system may determine to store misbehavior report(s). The decision to store misbehavior report(s) may depend on a plurality of factors, such as: (i) a misbehavior is detected but with low confidence (and hence allow for collection of more evidence and increase certainty), (ii) detectors require a larger message set (e.g. a misbehavior is detected but requires a certain number of messages from neighboring devices), (iii) storage is required for blacklisting approach (which may store a hash of the remote vehicle certificate in a counting Bloom filter or Cuckoo filter), and/or (iv) no network connection to SCMS/PKI is available.

Figure 5A:
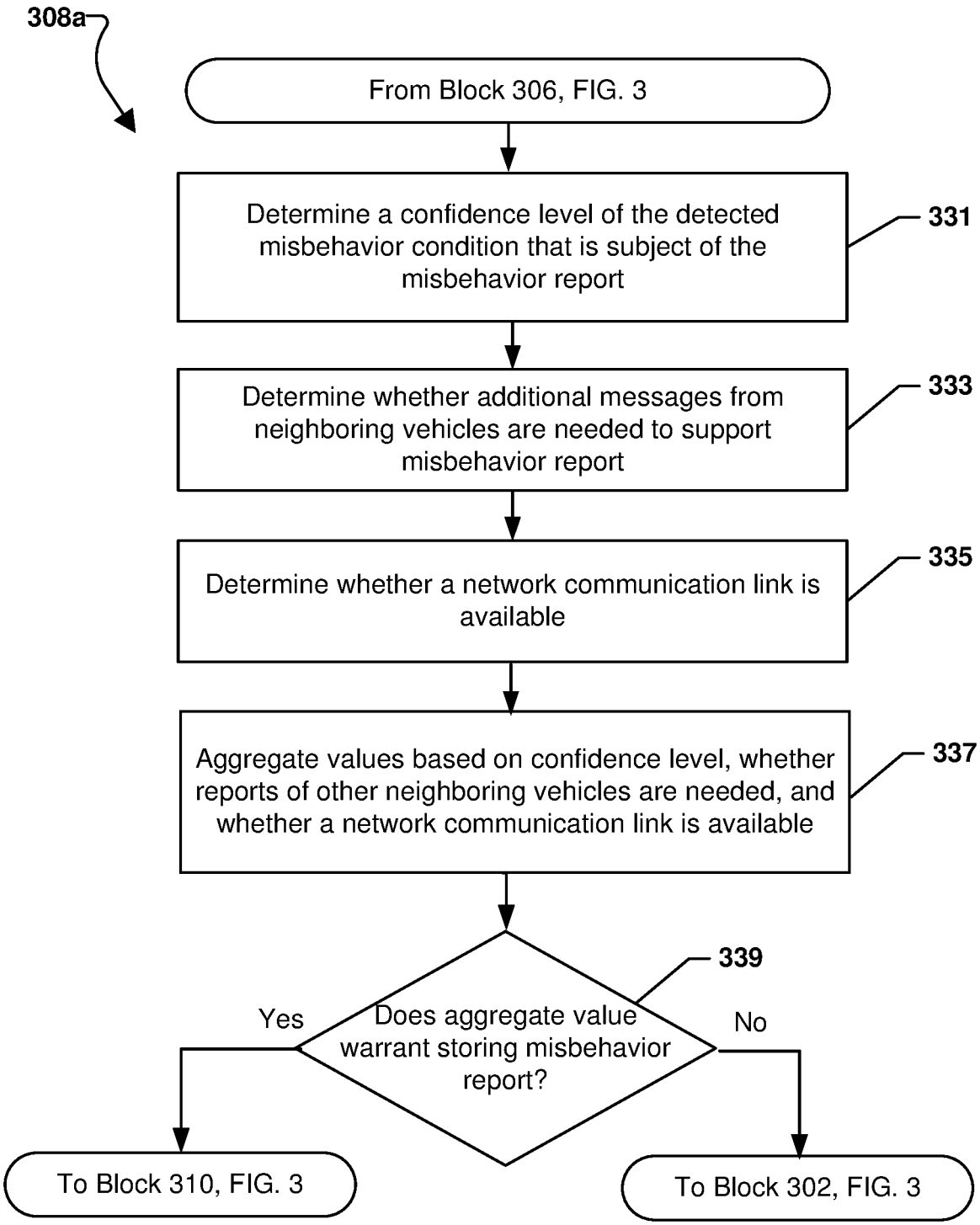
FIGS. 5A and 5B are process flow diagrams of example methods of determining whether to store misbehavior reports by a Misbehavior Management System.

FIG. 5A illustrates an embodiment method 308*a* for determining whether a misbehavior report should be stored in determination block 308. With reference to FIGS. 1-5A, after a misbehavior report is generated, a determination as to whether the misbehavior report should be stored in memory. In light of limited memory capacity and the volume of potential misbehavior conditions that may be detected, the Misbehavior management system may determine which of the generated misbehavior report should be stored in memory. In a manner similar to the determination of whether to generate a misbehavior report for a detected misbehavior condition illustrated in FIG. 4A, the misbehavior report may review and determine a number of criteria related to the storage of a generated misbehavior report and assign a value to the generated misbehavior report for a particular criteria. The Misbehavior management system may aggregate the assigned values and determine whether the aggregated value exceeds a threshold. In response to determining that the threshold is exceeded, Misbehavior management system may store the generated misbehavior report in block 310.

For example, after a misbehavior report is generated in block 306, the Misbehavior management system may determine a confidence level of the detected misbehavior condition that is the subject of the generated misbehavior report in block 331. As discussed above, a number of data points may support a higher confidence level of the detected misbehavior condition. As an example, a number of neighboring vehicles may provide indications of their observations that a basic safety message (BSM) that is received from another vehicle is inaccurate. If a large number of neighboring vehicles provide supporting evidence that a BSM is inaccurate, the confidence level that the misbehavior condition is detected may be high. In other examples, conflicting sensor data among a vehicles plurality of sensor may lead the Misbehavior management system to conclude that a misbehavior condition has occurred. If an overwhelming number of other sensor data contradicts the data from a particular sensor, the Misbehavior management system may conclude with relative high confidence that a misbehavior condition has occurred. In any of these examples, a confidence value may be assigned to the detected misbehavior condition.

In addition, the Misbehavior management system may determine in block 333 whether additional messages from neighboring vehicles are needed to support a misbehavior report. For example, as discussed above, a Misbehavior management system may receive indications from neighboring vehicles that their respective observations contradict a BSM that was received from the initial vehicle. Each of these indications may support and bolster the confidence level that a misbehavior condition is accurately detected. However, each of these additional messages that are appended to the data that supports the misbehavior report increases the size of the misbehavior report that is to be stored. Thus, valuable storage space may be utilized. In some embodiments, a determination may be made that such large misbehavior report with additional messages from neighboring vehicles are too large to store. In some embodiments, such misbehavior report may be assigned a value that may not support a determination to store the misbehavior report because it is too large. However, in other embodiments, such misbehavior reports with supporting evidence may be assigned a value that supports a greater likelihood that the misbehavior report will be stored.

In addition, the Misbehavior management system may determine whether a communication link to a misbehavior managing authority is available in block 335. In instances where a communication link to a misbehavior managing authority is available, the Misbehavior management system may transmit the misbehavior report to a remote misbehavior managing authority for analysis and storage. As such it may not be necessary to store the misbehavior report locally in the V2X equipment. Thus, the Misbehavior management system may assign a value to the misbehavior report that would support not storing the misbehavior report locally when a communication link to a misbehavior managing authority is available.

In determination block 339, the Misbehavior management system may aggregate the values that are assigned by the Misbehavior management system based on the confidence level of the detected misbehavior condition determined in block 331, the number of neighboring vehicles that experience the misbehavior condition determined in block 333, and whether a communication link to a misbehavior managing authority is available determined in block 337, and determine whether the aggregated value for the misbehavior report exceeds a threshold value.

In response to determining that the aggregated value exceeds the threshold value (i.e. determination block 339="Yes"), the Misbehavior management system may store a misbehavior report in block 310.

In response to determining that the aggregated value does not exceed a threshold value (i.e., determination block 339="No"), the Misbehavior management system may continue to monitor for other misbehavior conditions in block 302. In some embodiments, the values assigned to each of the criteria used to determine whether to store a misbehavior report may be lower values for more serious conditions that warrant the storage of a misbehavior report. In such embodiments, an aggregate value that is lower than a threshold value would exceed the threshold value. In other embodiments, the values assigned to each of the criteria used to determine whether to store a misbehavior report may be higher values for more serious conditions that warrant the storage of a misbehavior report. In such embodiments, an aggregate value that is higher than a threshold value would exceed the threshold value.

Figure 5B:
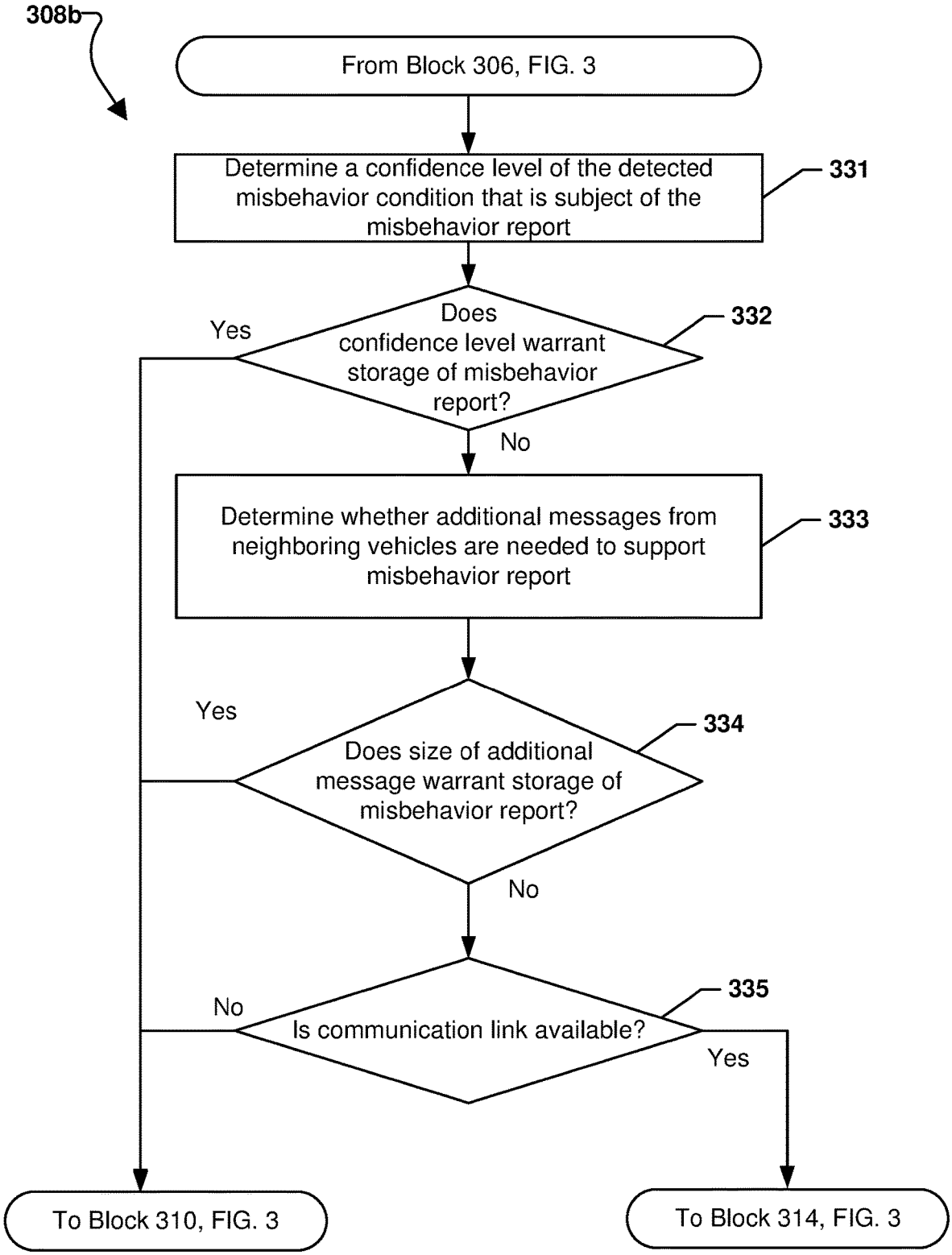

FIG. 5B illustrates an alternative embodiment method 308*b* for determining whether to store a misbehavior report in determination block 308. With reference to FIGS. 1-5B, the method 308*b* may include the operations of determining confidence level of the detected misbehavior condition in block 331, determining the number of neighboring vehicles that experience the misbehavior condition in block 333, and determining whether a communication link to a misbehavior managing authority is available in block 337 of the method 308*a* as described. However, in contrast to the method 308*a*, after each determination operation, a separate determination may be made regarding whether the assigned value for each criteria exceeds a threshold value such that a misbehavior report may be stored.

For example, after determining confidence level of the detected misbehavior condition in block 331, and assigning a value based on the confidence level of the detected misbehavior condition, the Misbehavior management system may determine whether the assigned value exceeds a threshold in determination block 332. In response to determining that the assigned value based on the confidence level exceeds the threshold (i.e., determination block 332="Yes"), the Misbehavior management system may store a misbehavior report in local memory in block 310. In response to determining that the value assigned based on the classification of the detected misbehavior does not exceed the threshold (i.e., determination block 332="No"), the Misbehavior management system may determine the number of neighboring vehicles that experience the misbehavior condition in block 333.

After determining the number of neighboring vehicles that experience the misbehavior condition in block 333, and assigning a value based on the number of neighboring vehicles that experience the detected misbehavior condition, the Misbehavior management system may determine whether the assigned value based on the number of neighboring vehicles exceeds a threshold in determination block 334. In response to determining that the assigned value exceeds a threshold (i.e., determination block 334="Yes"), the Misbehavior management system may store a misbehavior report in local memory in block 310 of the method 300 as described.

In response to determining that the value assigned based on the number of neighboring vehicles does not exceed a threshold (i.e., determination block 334="No"), the Misbehavior management system may determine whether a communication link to a misbehavior managing authority is available in determination block 335. In response to determining that a communication link to a misbehavior managing authority is available (i.e., determination block 335="Yes"), the Misbehavior management system may determine to transmit the misbehavior report to the misbehavior managing authority in block 314 of the method 300 as described. In response to determining that the communication link to a misbehavior managing authority is not available (i.e., determination block 335="No"), the Misbehavior management system may store the misbehavior report in local memory in block 310 of the method 300 as described.

In addition to determining whether to store a misbehavior report, the Misbehavior management system may determine when to delete or flush stored misbehavior reports from local storage to make room for more recently generated misbehavior reports. To facilitate this determination, a weight may be assigned to each stored misbehavior report. The weight assigned to each stored misbehavior report may also be used by the Misbehavior management system to determine a priority of transmission of a particular misbehavior report. For example, in determination block 312 of the method 300 (FIG. 3), the Misbehavior management system may prioritize one stored misbehavior report over another based on the respective weights of the stored misbehavior reports.

Figure 6:
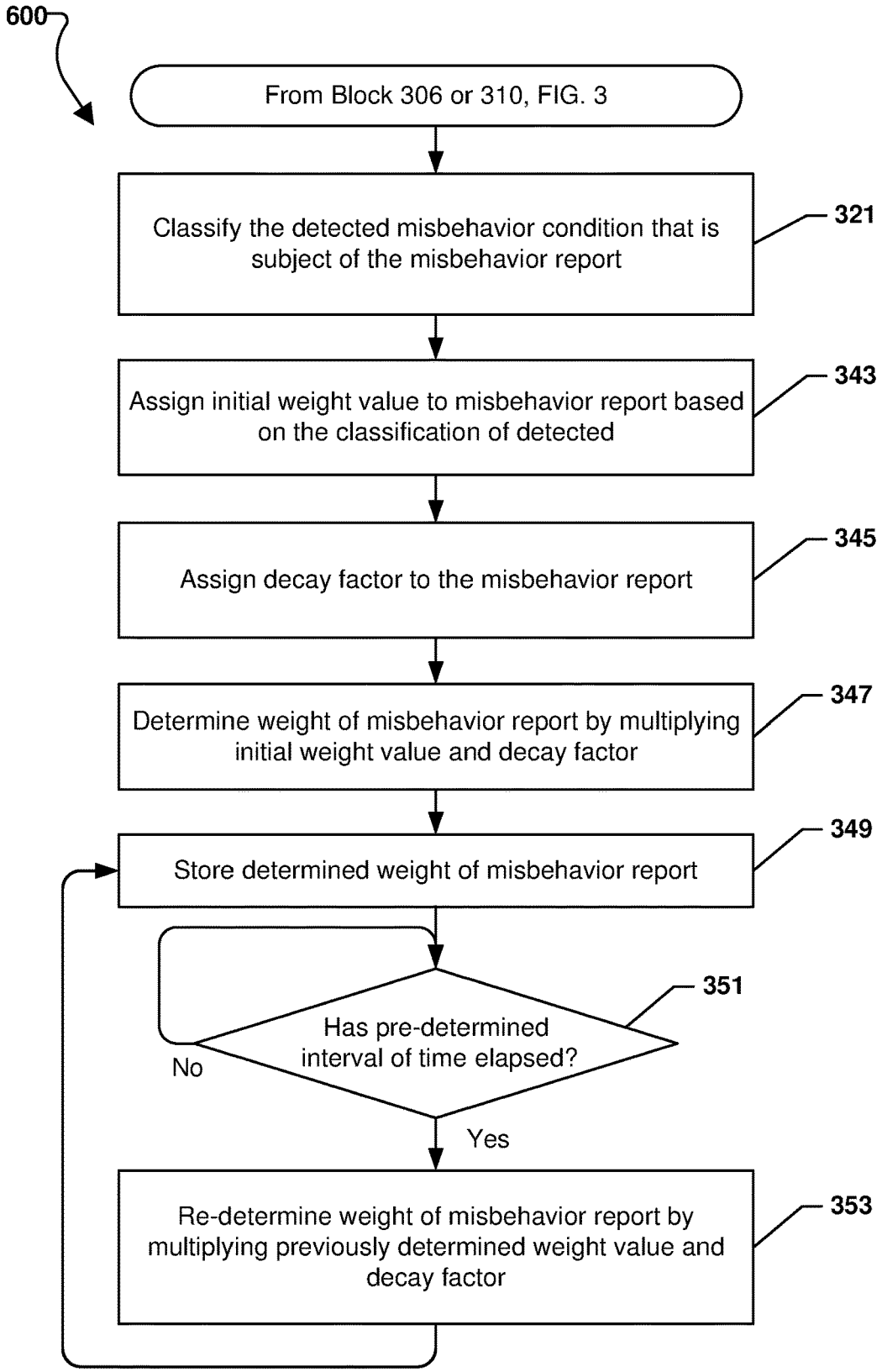
FIG. 6 is process flow diagrams of example methods of calculating a weight of a generated misbehavior report by a Misbehavior Management System.

FIG. 6 illustrates a method 600 for calculating a weight for a generated misbehavior report. With reference to FIGS. 1-6, the method 600 may be performed by the Misbehavior management system after the misbehavior report is generated or after the generated misbehavior report is stored. As discussed above, the detected misbehavior condition that is the subject of the generated misbehavior report may be classified by the Misbehavior management system in block 321. For example, the misbehavior condition may be classified into one of two categories, such as a misbehavior that is related to a potential safety issue or a misbehavior that is related to potential road traffic disruption.

In block 343, the Misbehavior management system may assign an initial weight value to the misbehavior condition to identify it as either misbehavior that is related to a potential safety issue or a misbehavior that is related to potential road traffic disruption. While in some embodiments, misbehavior conditions may be classified as either misbehavior that is related to a potential safety issue or a misbehavior that is related to potential road traffic disruption, in other embodiments, the misbehavior condition may be assigned an initial weight value on a singular sliding scale. For example, misbehavior conditions that are related to safety issues that may result in serious harm may be assigned a high initial weight value. Misbehavior conditions that are related only to road traffic disruptions may be assigned a low initial weight value. Other misbehavior conditions that may be related to both potential safety issue and related to potential road traffic disruption may be assigned an intermediate initial weight value based on the misbehavior condition's relative potential harm vis-a-vis inconvenience. Other factors may impact the assigned initial weight or trigger an adjustment or revision to the assigned initial weight. For example, if multiple instances of the same misbehavior are observed from the same source, then each instance of the misbehavior may get weighted differently. In some embodiments, if multiple instances of the same misbehavior are observed from the same source, this may prompt or trigger the Misbehavior management system to aggregate each instance of the misbehavior and weight each instance with a higher weight. In some embodiments, if the Misbehavior management system receives a command from a misbehavior managing authority 136 (or misbehavior authority preprocessing entity unit 132, 134) to update the assigned initial weight, such a command may prompt or trigger the Misbehavior management system adjust weights accordingly. Such updates by the Misbehavior management system may increase or decrease the assigned initial weight. In some embodiments, a device or vehicle may experience an event that results in an increase in the initial weight assigned to a misbehavior condition.

As stated earlier, the initial weight may depend not just on the misbehavior report classification but also on how severe the underlying misbehavior is, and/or based on how much it exceeds a reporting threshold. For example, in the case where yaw rate should be consistent with velocity and lateral acceleration, an inconsistency of 25% would get a higher initial weight than an inconsistency of 5%.

In some embodiments, the aggregate values that may be determined in block 329 may be used as an assigned initial weight to the misbehavior condition in block 343. For example, the values assigned to a detected misbehavior condition by the misbehavior management system in block 329 shown in FIG. 4A may include values based on one or more of the classification of the detected misbehavior condition made in block 321, the observed length of the detected misbehavior determined in block 323, the number of occurrences of the detected misbehaviors determined in block 325, and/or the number of neighboring vehicles that experience the misbehavior condition determined in block 327.

In addition to an initial weight value, the Misbehavior management system may assign a decay factor to the misbehavior report in block 345. The decay factor may be a value greater than 0 and less than 1. The decay factor may be associated with a pre-determined time interval. For example, the pre-determined time interval may be hours, days, weeks, or a month. In some embodiments, when the volume of misbehavior reports that are to be generated is large, the Misbehavior management system may assign a decay factor with a shorter pre-determined time interval. In some embodiments, a smaller decay factor may be used to decrease the number of viable misbehavior reports for storage and/or transmission. In some embodiments, a combination of shorter pre-determined time interval and smaller decay factors may facilitate a decrease in the overall number of misbehavior reports that are determined by the Misbehavior management system for storage and/or transmission.

In block 347, the Misbehavior management system may determine an initial weight of the misbehavior report, such as by multiplying the assigned initial weight value of the misbehavior report and the decay factor.

In block 349, the Misbehavior management system may store this determined weight along with the associated misbehavior report. The Misbehavior management system may retrieve and use this stored determined weight as a factor to determine whether to store the associated misbehavior report in determination block 308 of the method 300 (FIG. 3), determination block 330 of the operations 304 (FIG. 4A), and/or determination block 339 of the operations 308*a* (FIG. 5A).

The Misbehavior management system may use a counter, timer, and/or clock to maintain the pre-determined time interval. The Misbehavior management system may determine whether the pre-determined interval of time has elapsed in determination block 351. In response to determining that the predetermined interval of time has not elapsed (i.e., determination block 351="No"), the Misbehavior management system may return at a later time to determine if the pre-determined interval of time has elapsed.

In response to determining that the predetermined interval of time has elapsed (i.e., determination 351=Yes), the Misbehavior management system may determine a new weight of the misbehavior report in block 353. In order to recalculate the weight of the misbehavior report, the Misbehavior management system may retrieve the previously determined weight value from storage and multiply that value by the decay factor.

The Misbehavior management system may store the re-determined weight value of the misbehavior report in block 349. Once the determined weight or re-determined weight value is stored, this value may be used by the Misbehavior management system to determine whether to store, delete, and/or transmit the misbehavior report based on the stored determined weight value.

Figure 7:
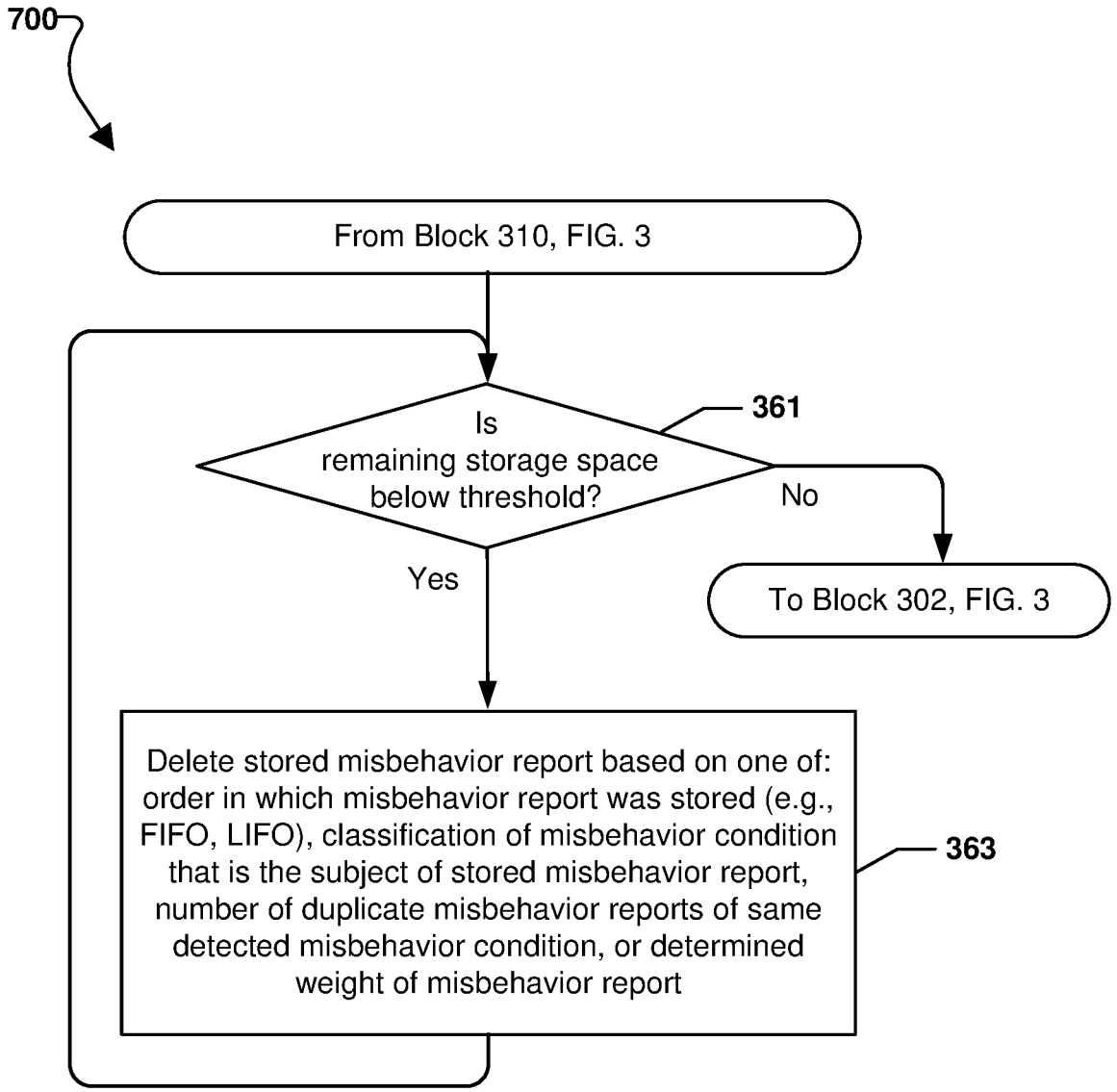
FIG. 7 is process flow diagrams of example methods of determining which stored misbehavior report may be deleted by a Misbehavior Management System.

FIG. 7 illustrates a method 700 of a flush/delete process that may utilize the determined weight of the misbehavior reports. With reference to FIGS. 1-7, after a misbehavior report is stored in block 310 of the method 300, the Misbehavior management system may audit the available remaining storage space in local memory and determine whether the remaining storage space is below a threshold amount in determination block 361. When the Misbehavior management system detects low storage space, the Misbehavior management system may flush misbehavior reports in any of a number of manners, such as: (i) first in/first out (FIFO), (ii) least serious/dangerous/disruptive first, (iii) duplicates first (assuming misbehavior reports were generated to report the same senderID and same misbehavior—the system could aggregate misbehavior reports prior to deletion of older duplicates), and/or (iv) based on individual current misbehavior report weight.

In response to determining that the remaining storage space is below a threshold amount (i.e., determination block 361="Yes"), the Misbehavior management system may delete a stored misbehavior report in block 363. Selection of the misbehavior report for deletion may be based on one of order of storage (e.g., FIFO or last in/first out (LIFO)), the classification type of the misbehavior report, the number of misbehavior reports that report the same duplicate misbehavior condition, or a determined weight of the misbehavior as determined in the method 600 (FIG. 6). Some embodiment Misbehavior management systems may elect to delete stored misbehavior reports on a FIFO or LIFO scheme. Some embodiment Misbehavior management systems may elect to delete stored misbehavior report such that only misbehavior reports that report on inconvenience of potential traffic disruption are deleted. In this manner, any misbehavior report related to safety issues may be preserved. In some Misbehavior management systems, reports that include duplicate misbehaviors may be selected for deletion. In some embodiments, values representing any and all of these factors may be provided and aggregated. The determination as to which misbehavior report to delete may be made based on the aggregate value of these factors.

In response to determining that the remaining storage space is above threshold amount (i.e., determination block 361="No"), the Misbehavior management system may continue to monitor for misbehavior conditions in block 302 of the method 300 as described.

An alternative to deleting misbehavior reports is to offload misbehavior report storage to another module (e.g. smartphone, edge device, other vehicles) as long as the misbehavior reports are encrypted and signed. The determination of which misbehavior report to offload could follow the deletion or transmission rules described herein.

Figure 8:
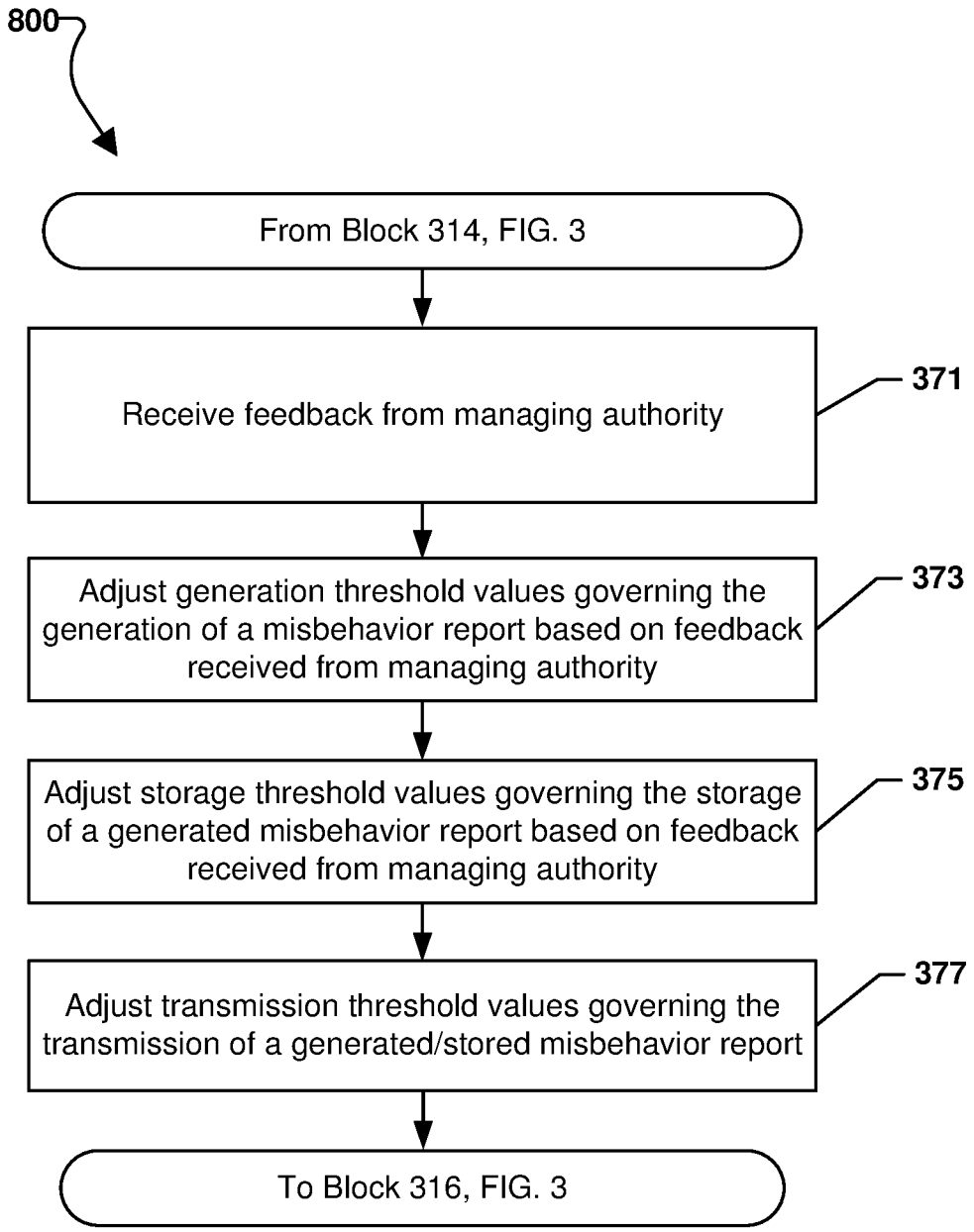
FIG. 8 is process flow diagrams of example methods of adjusting threshold values in a feedback signal by a Misbehavior Management System.

As MBRs are transmitted to a central misbehavior managing authority, such as a SCMS, the manner in which the Misbehavior managing system determines whether to generate misbehavior reports, store misbehavior reports and transmit misbehavior reports may be modified. FIG. 8 illustrates a method 800 to modify the manner in which a Misbehavior management system may be modified.

With reference to FIGS. 1-8, following the operations in block 314 of the method 300, the Misbehavior management system may receive feedback from the central misbehavior managing authority such as a SCMS in block 371. This feedback may be a message sent from the central misbehavior managing authority to the vehicle Misbehavior management system confirming or declining the existence of a misbehavior condition event. For instance, the feedback message may contain a Boolean/binary value indicating whether the misbehavior report content that was transmitted by the Misbehavior management system is correct (response value equals to true) or incorrect (response value equals to false). In some embodiments, the local misbehavior detection system (the one belonging to the end entity) can update its initial weight factor. For example, an end entity may lower the confidence level of its local detection system if the Misbehavior management system does not agree with the local detection system.

As discussed above, in each of the various determinations, various weight and values may be assigned to a variety of factors based on how the Misbehavior management system elects to emphasize certain factors over others. For example, in some embodiments, the Misbehavior management system may attribute repeated occurrences of the same misbehavior condition to a faulty sensor and disregarded as a minor inconvenience. In such embodiments, the Misbehavior management system may assign lower priority values to repetitive occurrences. However, the feedback received from a central misbehavior managing authority may modify the factors that the Misbehavior management system uses to make its various determinations. Moreover, the threshold values that may result in a decision to generate, store and/or transmit may be modified based on feedback from the central misbehavior managing authority. In the method 800, each of the generation threshold values, storage threshold values, and transmission threshold values that govern each of these determinations may be adjusted in blocks 373, 375, 377. Once the adjustments to the various values are made, the Misbehavior management system may again monitor sensor data for further misbehavior conditions in block 302 of the method 300.

For example, with reference to FIGS. 4A, 4B and 8, the misbehavior managing authority may provide feedback that alters the values assigned to or thresholds used by the Misbehavior management system to evaluate certain detected misbehavior conditions such that only misbehavior conditions related to the most severe safety conditions and/or that persist for an extended length of time result in the generation of a misbehavior report. In some embodiments, the feedback from the misbehavior managing authority may inform the Misbehavior management system operating on a particular vehicle's V2X equipment (i.e., 102, 104, 106) that a certain type of misbehavior is deprecated, which in turn may deprecate the aggregated criticality value and hence no reports should be generated identifying that particular misbehavior condition.

An example of an embodiment method is now described. A vehicle 12 with on-board V2X equipment 102 may receive a Basic Safety Message with erroneous data. The local misbehavior detection system analyzes the BSM and may conclude that the remote sender A (e.g., vehicle 14) is misbehaving, noting that the sender is sending fake position that has the potential to trigger a wrong Electronic Emergency Brake Light warning. The Misbehavior management system decides to generate a Misbehavior Report (MBR-A). The Misbehavior management system may collect the evidence (e.g., vehicle 12 own BSM, remote sender BSM, list of detectors triggered, etc.), and classify the misbehavior condition as a "fake kinematic state" and assign a seriousness value of "high". The Misbehavior management system may then determine to store MBR-A with an initial weight value of 1 and a decay factor of 0.1. In this example, the vehicle 12 with on-board V2X equipment 102 does not have a connection to the SCMS (to upload the misbehavior report), hence the vehicle 12 with on-board V2X equipment 102 has to wait before transmitting it. The next day (i.e., pre-determined time interval=day), the Misbehavior management system applies the decay factor to MBR-A, decreasing its priority to 0.9. The vehicle 12 with on-board V2X equipment 102 detects another misbehavior condition by a different remote sender B (e.g., vehicle 16). Sender B's misbehavior condition is a position jump within the communication range but nothing safety-critical. Therefore, MBR-B may be stored with a priority value of 0.5 and a decay factor of 0.2. The vehicle 12 with on-board V2X equipment 102 establishes a connection with the SCMS and starts uploading its stored misbehavior reports, following the priority values: MBR-A→MBR-B. The Misbehavior management system keeps a record of identifiers A and B for blacklisting purposes and deletes MBR-A and MBR-B after acknowledgement of successful upload. (Optional) Two days later, the Misbehavior Managing Authority has completed its misbehavior investigation and would like to give feedback to the Misbehavior management system. The vehicle 12 with on-board V2X equipment 102 receives a notification that MBR-A was accurate while MBR-B was not accurate. The Misbehavior management system then may adjust its generation/storage/transmission parameters accordingly, and inform the local misbehavior detection system in order to adjust its internal parameters.

Figure 9:
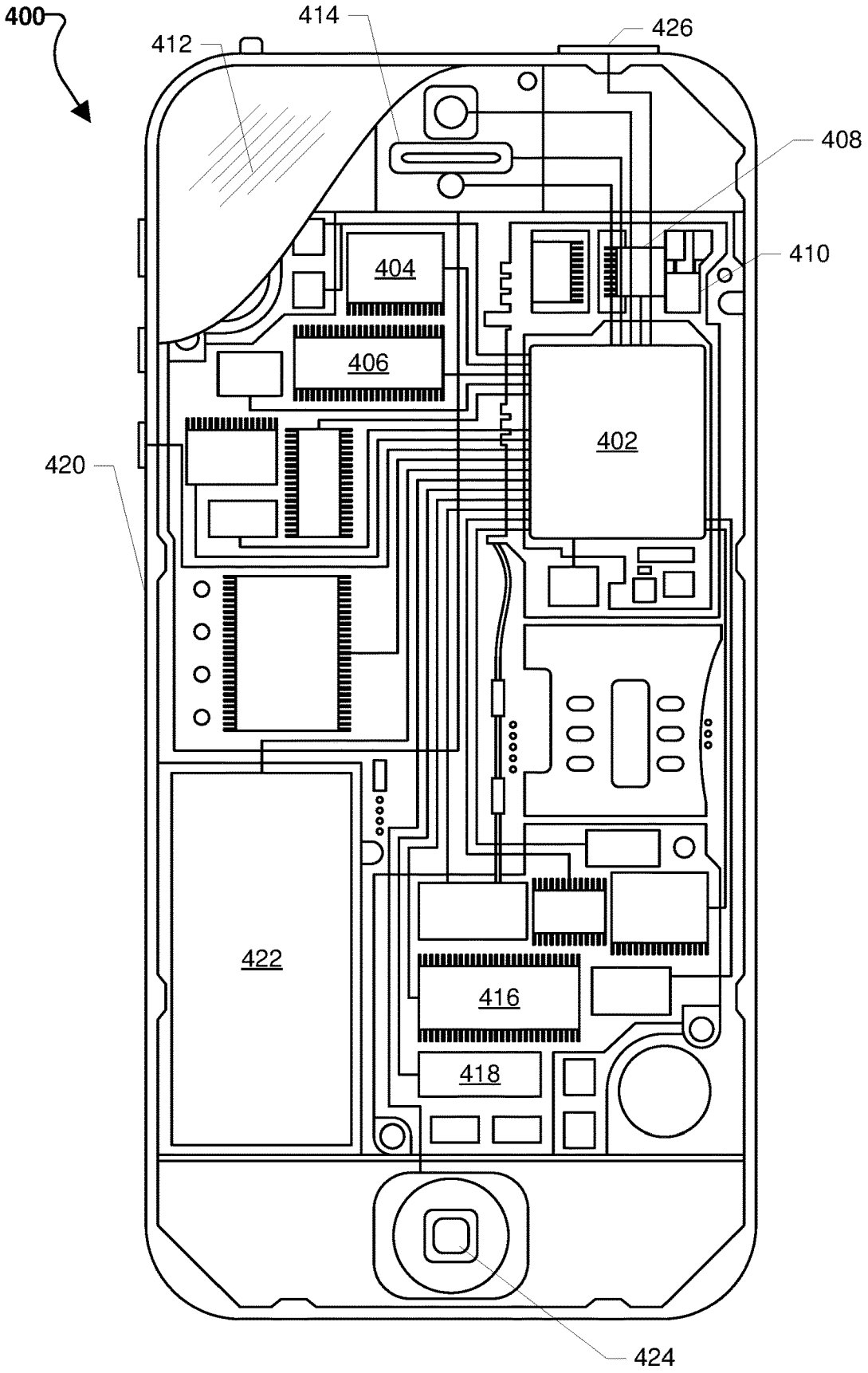
FIG. 9 is a component block diagram illustrating an example mobile computing device suitable for use with the various embodiments.

Various embodiments (including, but not limited to, embodiments described above with reference to FIGS. 1-8) may be implemented in a wide variety of computing systems including on-board equipment as well as mobile computing devices, an example of which suitable for use with the various embodiments is illustrated in FIG. 9. The mobile computing device 400 may include a processor 402 coupled to a touchscreen controller 404 and an internal memory 406. The processor 402 may be one or more multicore integrated circuits designated for general or specific processing tasks. The internal memory 406 may be volatile or non-volatile memory, and may also be secure and/or encrypted memory, or unsecure and/or unencrypted memory, or any combination thereof. Examples of memory types that can be leveraged include but are not limited to DDR, LPDDR, GDDR, WIDEIO, RAM, SRAM, DRAM, P-RAM, R-RAM, M-RAM, STT-RAM, and embedded DRAM. The touchscreen controller 404 and the processor 402 may also be coupled to a touchscreen panel 412, such as a resistive-sensing touchscreen, capacitive-sensing touchscreen, infrared sensing touchscreen, etc. Additionally, the display of the mobile computing device 400 need not have touch screen capability.

The mobile computing device 400 may have one or more radio signal transceivers 408 (e.g., Peanut, Bluetooth, ZigBee, Wi-Fi, RF radio) and antennae 410, for sending and receiving communications, coupled to each other and/or to the processor 402. The transceivers 408 and antennae 410 may be used with the above-mentioned circuitry to implement the various wireless transmission protocol stacks and interfaces. The mobile computing device 400 may include a cellular network wireless modem chip 416 that enables communication via a cellular network and is coupled to the processor.

The mobile computing device 400 may include a peripheral device connection interface 418 coupled to the processor 402. The peripheral device connection interface 418 may be singularly configured to accept one type of connection, or may be configured to accept various types of physical and communication connections, common or proprietary, such as Universal Serial Bus (USB), FireWire, Thunderbolt, or PCIe. The peripheral device connection interface 418 may also be coupled to a similarly configured peripheral device connection port (not shown).

The mobile computing device 400 may also include speakers 414 for providing audio outputs. The mobile computing device 400 may also include a housing 420, constructed of a plastic, metal, or a combination of materials, for containing all or some of the components described herein.

One of ordinary skill in the art may recognize that the housing 420 may be a dashboard counsel of a vehicle in an on-board embodiment. The mobile computing device 400 may include a power source 422 coupled to the processor 402, such as a disposable or rechargeable battery. The rechargeable battery may also be coupled to the peripheral device connection port to receive a charging current from a source external to the mobile computing device 400. The mobile computing device 400 may also include a physical button 424 for receiving user inputs. The mobile computing device 400 may also include a power button 426 for turning the mobile computing device 400 on and off.

Figure 10:
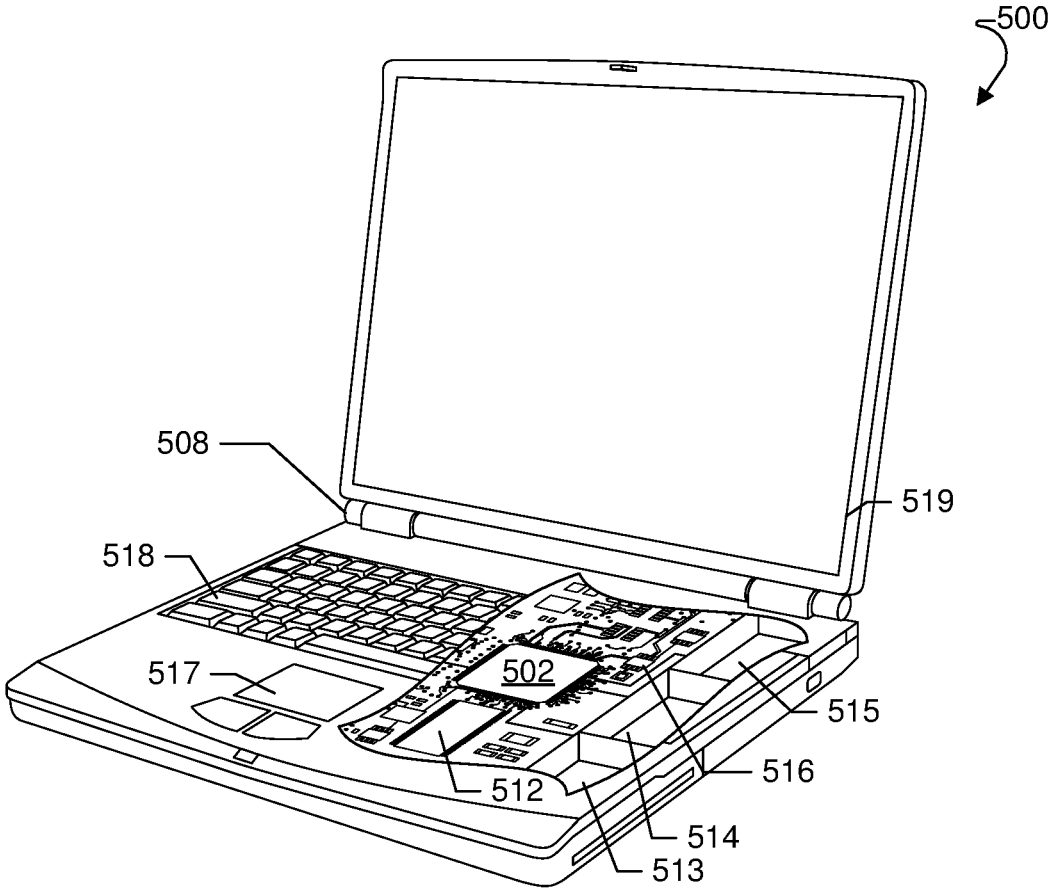
FIG. 10 is a component block diagram illustrating an example mobile computing device suitable for use with the various embodiments.

Various embodiments (including, but not limited to, embodiments described above with reference to FIGS. 1-8) may be implemented in a wide variety of computing systems include a laptop computer 500 an example of which is illustrated in FIG. 10. Many laptop computers include a touchpad touch surface 517 that serves as the computer's pointing device, and thus may receive drag, scroll, and flick gestures similar to those implemented on computing devices equipped with a touch screen display and described above. A laptop computer 500 will typically include a processor 502 coupled to volatile memory 512 and a large capacity nonvolatile memory, such as a disk drive 513 of Flash memory. Additionally, the computer 500 may have one or more antenna 508 for sending and receiving electromagnetic radiation that may be connected to a wireless data link and/or cellular telephone transceiver 516 coupled to the processor 502. The computer 500 may also include a floppy disc drive 514 and a compact disc (CD) drive 515 coupled to the processor 502. In a notebook configuration, the computer housing includes the touchpad 517, the keyboard 518, and the display 519 all coupled to the processor 502. Other configurations of the computing device may include a computer mouse or trackball coupled to the processor (e.g., via a USB input) as are well known, which may also be used in conjunction with the various embodiments.

Figure 11:
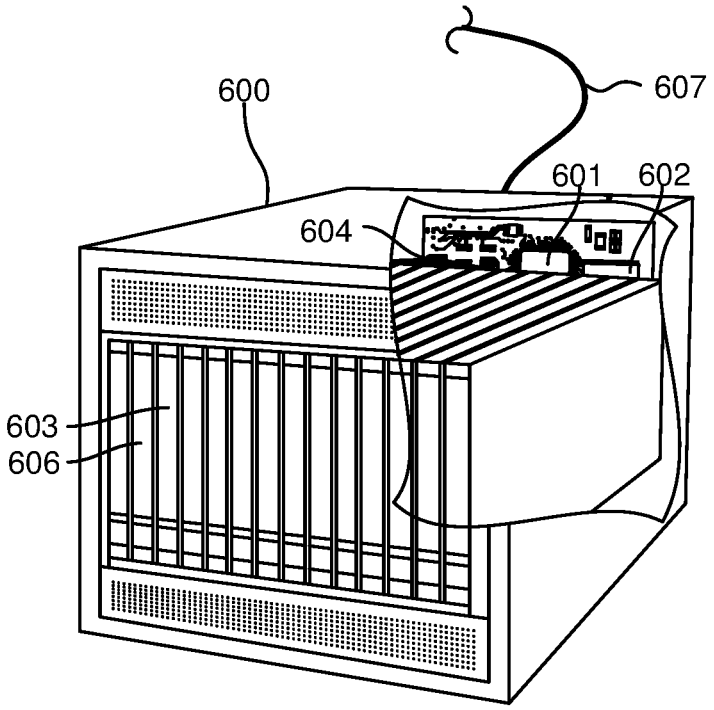
FIG. 11 is a component block diagram illustrating an example server suitable for use with the various embodiments.

Various embodiments (including, but not limited to, embodiments described above with reference to FIGS. 1-8) may also include a Misbehavior Managing Authority utilizes fixed computing systems, such as any of a variety of commercially available servers. An example server 600 is illustrated in FIG. 11. Such a server 600 typically includes one or more multicore processor assemblies 601 coupled to volatile memory 602 and a large capacity nonvolatile memory, such as a disk drive 604. As illustrated in FIG. 6, multicore processor assemblies 601 may be added to the server 600 by inserting them into the racks of the assembly. The server 600 may also include a floppy disc drive, compact disc (CD) or digital versatile disc (DVD) disc drive 606 coupled to the processor 601. The server 600 may also include network access ports 603 coupled to the multicore processor assemblies 601 for establishing network interface connections with a network 607, such as a local area network coupled to other broadcast system computers and servers, the Internet, the public switched telephone network, and/or a cellular data network (e.g., CDMA, TDMA, GSM, PCS, 3G, 4G, 5G, LTE, or any other type of cellular data network).

Implementation examples are described in the following paragraphs. While some of the following implementation examples are described in terms of example methods, further example implementations may include: the example methods discussed in the following paragraphs implemented by a misbehavior management system operating with a V2X equipment that may be an on-board unit, mobile device unit, mobile computing unit, or stationary roadside unit including a processor configured with processor-executable instructions to perform operations of the methods of the following implementation examples; the example methods discussed in the following paragraphs implemented by a V2X equipment including means for performing functions of the methods of the following implementation examples; and the example methods discussed in the following paragraphs may be implemented as a non-transitory processor-readable storage medium having stored thereon processor-executable instructions configured to cause a processor of a V2X equipment to perform the operations of the methods of the following implementation examples.

Example 1. A method of managing misbehavior reports, including determining whether to generate a misbehavior report to identify a misbehavior condition based on an aggregated criticality value in response to detection of the misbehavior condition; generating a misbehavior report identifying the misbehavior condition in response to determining to generate a misbehavior report to identify the misbehavior condition; determining whether to store the generated misbehavior report; and transmitting the generated misbehavior report to a misbehavior managing authority.

Example 2. The method of example 1, further including determining whether to transmit the generated misbehavior report to the misbehavior managing authority, wherein transmitting the generated misbehavior report to the misbehavior managing authority is performed in response to determining to transmit the generated misbehavior report.

Example 3. The method of either of examples 1 or 2, further including analyzing sensor data using a machine learning model to determine whether a misbehavior condition is detected, wherein generating the misbehavior report identifying the misbehavior condition comprises generating a misbehavior report that includes one or more of: the machine learning model; an output of the machine learning model; a principal component analysis of the machine learning model; an intermediate representation of the machine learning model; or an identifier of the machine learning model.

Example 4. The method of any of examples 1-3, including one or more of: classifying the misbehavior condition that is detected based on a potential safety impact of the misbehavior condition or a level of potential traffic disruption; determining an observed length of the misbehavior condition; determining a number of recurrences of the misbehavior condition; or determining a number of neighboring vehicles experiencing the misbehavior condition, the method further including generating the aggregated criticality value based on one or more of the misbehavior condition classification, the observed length of the misbehavior condition, the number of recurrences of the misbehavior condition, and the number of neighboring vehicles experiencing the misbehavior condition.

Example 5. The method of any of examples 1-4, further including one or more of: determining a confidence level of detection of the misbehavior condition that is the subject of the misbehavior report; determining whether additional messages from neighboring vehicles to accompany the misbehavior report; or determine whether a network communication link to the misbehavior managing authority is available to transmit the misbehavior report, wherein the method including determining whether to store the misbehavior report based on one or more of the confidence level of detection of the misbehavior condition, the number of additional message neighboring vehicles to accompany the misbehavior report, and whether a network communication link to the misbehavior managing authority is available to transmit the misbehavior report.

Example 6. The method of example 5, further including: classifying the detected misbehavior condition that is a subject of the generated misbehavior report based on a potential safety impact of the misbehavior condition; assigning an initial weight to the misbehavior report based on the classification of the misbehavior condition; assigning a decay factor to the misbehavior report; and multiplying the assigned initial weight by the decay factor on a regular interval to determine a determined weight of the misbehavior report, wherein determining whether to store the misbehavior report is further based on the determined weight of the misbehavior report.

Example 7. The method of example 5, further including: classifying the detected misbehavior condition that is a subject of the generated misbehavior report based on a level of potential traffic disruption; assigning an initial weight to the misbehavior report based on the classification of the misbehavior condition; assigning a decay factor to the misbehavior report; and multiplying the assigned initial weight by the decay factor on a regular interval to determine a determined weight of the misbehavior report, wherein determining whether to store the misbehavior report is further based on the determined weight of the misbehavior report.

Example 8. The method of examples 6 or 7, further including: determining whether an available storage space falls below a storage space threshold level; performing a flush operation in response to determining that the available storage space falls below a storage space threshold level, wherein the flush operation deletes stored misbehavior reports based on one of: an order that the misbehavior report is stored, a classification of the misbehavior condition, a number of duplicates stored duplication, and a determined weight of the misbehavior report.

Example 9. The method of example 8, wherein determining whether to transmit the misbehavior report is based on at least one of: the classification of the misbehavior condition; an order in which the misbehavior report is stored; or a fairness rule.

Example 10. The method of example 9, further including: receiving feedback from the misbehavior managing authority; and performing one or mote of: adjusting generation parameters that impact the determination to generate the misbehavior report to identify the misbehavior condition in response to the feedback; in response to the feedback, adjusting one or more thresholds for the confidence level of detection of the misbehavior condition, the number of additional message neighboring vehicles to accompany the misbehavior report, and whether a network communication link to the misbehavior managing authority is available to transmit the misbehavior report that are used to determine whether to store the generated misbehavior report in response to the feedback; or adjusting transmission parameters that impact the determination to transmit the misbehavior report to the misbehavior managing authority in response to the feedback.

Example 11. The method of any of examples 1-10, further including transmitting the misbehavior report to a misbehavior preprocessing entity for preprocessing before being sent to the Misbehavior Managing Authority.

The foregoing method descriptions and the process flow diagrams are provided merely as illustrative examples and are not intended to require or imply that the operations of various embodiments must be performed in the order presented. As will be appreciated by one of skill in the art the order of operations in the foregoing embodiments may be performed in any order. Words such as "thereafter," "then," "next," etc. are not intended to limit the order of the operations; these words are simply used to guide the reader through the description of the methods. Further, any reference to claim elements in the singular, for example, using the articles "a," "an" or "the" is not to be construed as limiting the element to the singular.

The various illustrative logical blocks, modules, circuits, and algorithm operations described in connection with the embodiments disclosed herein may be implemented as electronic hardware, computer software, or combinations of both. To clearly illustrate this interchangeability of hardware and software, various illustrative components, blocks, modules, circuits, and operations have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the claims.

The hardware used to implement the various illustrative logics, logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of computing devices. e.g., a combination of a DSP and a microprocessor, a plurality of microprocessors, one or more microprocessors in conjunction with a DSP core, or any other such configuration. Alternatively, some operations or methods may be performed by circuitry that is specific to a given function.

In one or more embodiments, the functions described may be implemented in hardware, software, firmware, or any combination thereof. If implemented in software, the functions may be stored as one or more instructions or code on a non-transitory computer-readable medium or non-transitory processor-readable medium. The operations of a method or algorithm disclosed herein may be embodied in a processor-executable software module, which may reside on a non-transitory computer-readable or processor-readable storage medium. Non-transitory computer-readable or processor-readable storage media may be any storage media that may be accessed by a computer or a processor. By way of example but not limitation, such non-transitory computer-readable or processor-readable media may include RAM, ROM, EEPROM, FLASH memory, CD-ROM or other optical disk storage, magnetic disk storage or other magnetic storage devices, or any other medium that may be used to store desired program code in the form of instructions or data structures and that may be accessed by a computer. Disk and disc, as used herein, includes compact disc (CD), laser disc, optical disc, digital versatile disc (DVD), floppy disk, and Blu-ray disc where disks usually reproduce data magnetically, while discs reproduce data optically with lasers. Combinations of the above are also included within the scope of non-transitory computer-readable and processor-readable media. Additionally, the operations of a method or algorithm may reside as one or any combination or set of codes and/or instructions on a non-transitory processor-readable medium and/or computer-readable medium, which may be incorporated into a computer program product.

The preceding description of the disclosed embodiments is provided to enable any person skilled in the art to make or use the claims. Various modifications to these embodiments will be readily apparent to those skilled in the art, and the generic principles defined herein may be applied to other embodiments without departing from the scope of the claims. Thus, the present disclosure is not intended to be limited to the embodiments shown herein but is to be accorded the widest scope consistent with the following claims and the principles and novel features disclosed herein.

What is claimed is:

1. A method, performed by a processor of vehicle-to-everything (V2X) equipment, for managing misbehavior reports, comprising:

generating a misbehavior report identifying a misbehavior condition associated with at least one of inaccurate or corrupted data in response to the misbehavior condition being associated with an aggregated criticality value that exceeds a threshold;

storing the generated misbehavior report in response to determining whether to store the generated misbehavior report based on an assigned level of criticality; and one or more of:

classifying the misbehavior condition that is detected based on a potential safety impact of the misbehavior condition or a level of potential traffic disruption;

determining an observed length of the misbehavior condition;

determining a number of recurrences of the misbehavior condition; or determining a number of neighboring vehicles experiencing the misbehavior condition, and further comprising generating the aggregated criticality value based on one or more of the classification of the misbehavior condition, the observed length of the misbehavior condition, the number of recurrences of the misbehavior condition, and the number of neighboring vehicles experiencing the misbehavior condition.

2. The method of claim 1, further comprising:

transmitting the generated misbehavior report to a misbehavior managing authority.

3. The method of either of claim 2, further comprising analyzing sensor data using a machine learning model to determine whether a misbehavior condition is detected, wherein generating the misbehavior report identifying the misbehavior condition comprises generating a misbehavior report that includes one or more of: the machine learning model; an output of the machine learning model; a principal component analysis of the machine learning model; an intermediate representation of the machine learning model; or an identifier of the machine learning model.

4. The method of claim 1, further comprising one or more of:

determining a confidence level of detection of the misbehavior condition that is a subject of the misbehavior report;

determining a number of additional messages from one or more neighboring vehicles available to accompany the misbehavior report; or determining a network communication link to the misbehavior managing authority that is available to transmit the misbehavior report, or storing the generated misbehavior report is further based on one or more of the confidence level of detection of the misbehavior condition, the number of additional messages from the one or more neighboring vehicles available to accompany the misbehavior report, or the network communication link to the misbehavior managing authority being available to transmit the misbehavior report.

5. The method of claim 4, further comprising:

classifying the detected misbehavior condition that is a subject of the generated misbehavior report based on a potential safety impact of the misbehavior condition;

assigning an initial weight to the misbehavior report based on the classification of the misbehavior condition;

assigning a decay factor to the misbehavior report; and determining a weight of the misbehavior report on a regular interval based on the assigned initial weight and the decay factor, wherein storing the generated misbehavior report is further based on the determined weight of the misbehavior report.

6. The method of claim 4, further comprising:

classifying the detected misbehavior condition that is a subject of the generated misbehavior report based on a potential safety impact of a level of potential traffic disruption;

assigning an initial weight to the misbehavior report based on the classification of the misbehavior condition;

assigning a decay factor to the misbehavior report; and determining a weight of the misbehavior report on a regular interval based on the assigned initial weight and the decay factor, wherein storing the generated misbehavior report is further based on the determined weight of the misbehavior report.

7. The method of claim 6, further comprising:

performing a flush operation in response to determining that an available storage space falls below a storage space threshold level, wherein the flush operation deletes stored misbehavior reports based on one of: an order that the misbehavior report is stored, a classification of the misbehavior condition, a number of duplicates stored duplication, or a determined weight of the misbehavior report.

8. The method of claim 7, further comprising transmitting the misbehavior report based on at least one of: the classification of the misbehavior condition; the order in which the misbehavior report is stored; or a fairness rule.

9. The method of claim 8, further comprising:

receiving feedback from the misbehavior managing authority; and performing one or more of:

adjusting generation parameters, wherein the misbehavior report is further in response to the feedback;

in response to the feedback, adjusting one or more thresholds for the confidence level of detection of the misbehavior condition, the number of additional messages from the one or more neighboring vehicles available to accompany the misbehavior report, and whether a network communication link to the misbehavior managing authority is available to transmit the misbehavior report that are used to determine whether to store the generated misbehavior report; or adjusting transmission parameters that impact whether the misbehavior report is transmitted to the misbehavior managing authority in response to the feedback.

10. The method of claim 2, further comprising transmitting the misbehavior report to a misbehavior preprocessing entity for preprocessing before being transmitted to the misbehavior managing authority.

11. A misbehavior management system for use in vehicle-to-everything (V2X) equipment, comprising:

a memory storage coupled to the transmitter and configured to store misbehavior reports; and a processor coupled to the memory storage, wherein the processor is configured with processor-executable instructions to:

generate a misbehavior report identifying a misbehavior condition associated with at least one of inaccurate or corrupted data in response to the misbehavior condition being associated with an aggregated criticality value that exceeds a threshold; and store the generated misbehavior report in response to determine whether to store the generated misbehavior report based on an assigned level of criticality;

one or more of:

classify the misbehavior condition that is detected based on a potential safety impact of the misbehavior condition or a level of potential traffic disruption;

determine an observed length of the misbehavior condition;

determine a number of recurrences of the misbehavior condition; or determine a number of neighboring vehicles experiencing the misbehavior condition, wherein the processor is further configured with processor-executable instructions to generate the misbehavior report to identify the misbehavior condition based on one or more of the classification of the misbehavior condition, the observed length of the misbehavior condition, the number of recurrences of the misbehavior condition, and the number of neighboring vehicles experiencing the misbehavior condition.

12. The misbehavior management system of claim 11, further comprising a transmitter coupled to the processor and configured to wireless transmit and receive data related to misbehavior reports to and from a misbehavior managing authority, wherein the processor is further configured with processor-executable instructions to:

transmit the generated misbehavior report to a misbehavior managing authority.

13. The misbehavior management system of claim 12, wherein the processor is further configured with processor-executable instructions to:

analyze sensor data using a machine learning model to determine whether a misbehavior condition is detected; and generate the misbehavior report identifying the misbehavior condition by generating a misbehavior report that includes one or more of: the machine learning model; an output of the machine learning model; a principal component analysis of the machine learning model; an intermediate representation of the machine learning model; or an identifier of the machine learning model.

14. The misbehavior management system of claim 11, wherein the processor is further configured with processor-executable instructions to perform one or more of:

determining a confidence level of detection of the misbehavior condition that is a subject of the misbehavior report;

determining a number of additional messages from one or more neighboring vehicles available to accompany the misbehavior report; or determine a network communication link to the misbehavior managing authority that is available to transmit the misbehavior report, and wherein the processor is further configured with processor-executable instructions to store the misbehavior report based on one or more of the confidence level of detection of the misbehavior condition, the number of additional messages from one or more neighboring vehicles available to accompany the misbehavior report, the network communication link to the misbehavior managing authority being available to transmit the misbehavior report.

15. The misbehavior management system of claim 14, wherein the processor is further configured with processor-executable instructions to:

classify the detected misbehavior condition that is a subject of the generated misbehavior report based on a potential safety impact of the misbehavior condition;

assign an initial weight to the misbehavior report based on the classification of the misbehavior condition;

assign a decay factor to the misbehavior report; and determine a weight of the misbehavior report on a regular interval based on the assigned initial weight and the decay factor, wherein storing the misbehavior report is further based on the determined weight of the misbehavior report.

16. The misbehavior management system of claim 15, wherein the processor is further configured with processor-executable instructions to:

classify the detected misbehavior condition that is a subject of the generated misbehavior report based on a potential safety impact of a level of potential traffic disruption;

assign an initial weight to the misbehavior report based on the classification of the misbehavior condition;

assign a decay factor to the misbehavior report; and determine a weight of the misbehavior report on a regular interval based on the assigned initial weight and the decay factor, wherein storing the misbehavior report is further based on the determined weight of the misbehavior report.

17. The misbehavior management system of claim 15, wherein the processor is further configured with processor-executable instructions to:

perform a flush operation in response to determining that an available storage space falls below a storage space threshold level, wherein the flush operation deletes stored misbehavior reports based on one of: an order that the misbehavior report is stored, a classification of the misbehavior condition, a number of duplicates stored duplication, or a determined weight of the misbehavior report.

18. The misbehavior management system of claim 17, further comprising a transmitter coupled to the processor and configured to wireless transmit and receive data related to misbehavior reports to and from a misbehavior managing authority, wherein the processor is further configured with processor-executable instructions to transmit the misbehavior report based on at least one of: the classification of the misbehavior condition, an order in which the misbehavior report is stored, or a fairness rule.

19. The misbehavior management system of claim 18, wherein the processor is further configured with processor-executable instructions to:

receive feedback from the misbehavior managing authority; and perform one or more of:

adjusting generation parameters, wherein generating the misbehavior report is further in response to the feedback;

in response to the feedback, adjusting one or more thresholds for the confidence level of detection of the misbehavior condition, the number of additional messages from the one or more neighboring vehicles available to accompany the misbehavior report, and whether a network communication link to the misbehavior managing authority is available to transmit the misbehavior report that are used to determine whether to store the generated misbehavior report; or adjusting transmission parameters that impact whether the misbehavior report is transmitted to the misbehavior managing authority in response to the feedback.

20. The misbehavior management system of claim 11, further comprising a transmitter coupled to the processor and configured to wireless transmit and receive data related to misbehavior reports to and from a misbehavior managing authority, wherein the processor is further configured with processor-executable instructions to transmit the misbehavior report to a misbehavior preprocessing entity for preprocessing before being transmitted to the misbehavior managing authority.

21. A misbehavior management system for use in Vehicle-to-Everything (V2X) equipment, comprising:

means for generating a misbehavior report identifying a misbehavior condition associated with at least one of inaccurate or corrupted data in response to the misbehavior condition being associated with an aggregated criticality value that exceeds a threshold; and means for storing the generated misbehavior report in response to determining whether to store the generated misbehavior report based on an assigned level of criticality;

one or more of:

means for classifying the misbehavior condition that is detected based on a potential safety impact of the misbehavior condition or a level of potential traffic disruption;

means for determining an observed length of the misbehavior condition; or means for determining a number of recurrences of the misbehavior condition; or means for determining a number of neighboring vehicles experiencing the misbehavior condition, and further comprising means for generating the aggregated criticality value based on one or more of the classification of the misbehavior condition, the observed length of the misbehavior condition, the number of recurrences of the misbehavior condition, or the number of neighboring vehicles experiencing the misbehavior condition.

22. The misbehavior management system of claim 21, further comprising means for transmitting the generated misbehavior report to a misbehavior managing authority.

23. The misbehavior management system included of claim 21, further comprising one or more of:

means for determining a confidence level of detection of the misbehavior condition that is a subject of the misbehavior report;

means for determining a number of additional messages from one or more neighboring vehicles available to accompany the misbehavior report; or means for determining a network communication link to the misbehavior managing authority that is available to transmit the misbehavior report, wherein means for storing the misbehavior report based on one or more of the confidence level of detection of the misbehavior condition, the number of additional messages from the one or more neighboring vehicles available to accompany the misbehavior report, the network communication link to the misbehavior managing authority being available to transmit the misbehavior report.

24. The misbehavior management system of claim 23, further comprising:

means for classifying the detected misbehavior condition that is a subject of the generated misbehavior report based on a potential safety impact of the misbehavior condition;

means for assigning an initial weight to the misbehavior report based on the classification of the misbehavior condition;

means for assigning a decay factor to the misbehavior report; and means for determining a weight of the misbehavior report on a regular interval based on the assigned initial weight and the decay factor, wherein storing the misbehavior report is further based on the determined weight of the misbehavior report.

25. The misbehavior management system of claim 24, further comprising:

means for classifying the detected misbehavior condition that is a subject of the generated misbehavior report based on a potential safety impact of a level of potential traffic disruption;

means for assigning an initial weight to the misbehavior report based on the classification of the misbehavior condition;

means for assigning a decay factor to the misbehavior report; and means for determining a weight of the misbehavior report on a regular interval based on the assigned initial weight and the decay factor, wherein storing the misbehavior report is further based on the determined weight of the misbehavior report.

26. The misbehavior management system of claim 25, further comprising means for transmitting the generated misbehavior report to a misbehavior managing authority, wherein means for transmitting the misbehavior report comprises means for transmitting the misbehavior report based on at least one of: the classification of the misbehavior condition; an order in which the misbehavior report is stored; or a fairness rule.

27. A non-transitory processor readable medium having stored thereon processor-executable instructions configured to cause a processor of a misbehavior management system to perform operations comprising:

generating a misbehavior report identifying a misbehavior condition associated with at least one of inaccurate or corrupted data in response to the misbehavior condition being associated with an aggregated criticality value that exceeds a threshold;

storing the generated misbehavior report in response to determining whether to store the generated misbehavior report based on an assigned level of criticality; and one or more of:

classifying the misbehavior condition that is detected based on a potential safety impact of the misbehavior condition or a level of potential traffic disruption;

determining an observed length of the misbehavior condition;

determining a number of recurrences of the misbehavior condition; or determining a number of neighboring vehicles experiencing the misbehavior condition, and further comprising generating the aggregated criticality value based on one or more of the classification of the misbehavior condition, the observed length of the misbehavior condition, the number of recurrences of the misbehavior condition, and the number of neighboring vehicles experiencing the misbehavior condition.

* * * * *